US011585627B2

(12) United States Patent
Webster et al.

(10) Patent No.: US 11,585,627 B2
(45) Date of Patent: Feb. 21, 2023

(54) ARCHERY BOW LIMB ADJUSTMENT SYSTEM

(71) Applicant: Hoyt Archery, Inc., Salt Lake City, UT (US)

(72) Inventors: John C. Webster, Stansbury Park, UT (US); Douglas E. Denton, Stansbury Park, UT (US)

(73) Assignee: HOYT ARCHERY, INC., Salt Lake City, UT (US)

( * ) Notice: Subject to any disclaimer, the term of this patent is extended or adjusted under 35 U.S.C. 154(b) by 0 days.

(21) Appl. No.: 17/139,726

(22) Filed: Dec. 31, 2020

(65) Prior Publication Data

US 2021/0222988 A1 Jul. 22, 2021

Related U.S. Application Data

(63) Continuation of application No. 16/403,960, filed on May 6, 2019, now Pat. No. 10,883,791.

(51) Int. Cl.
*F41B 5/14* (2006.01)

(52) U.S. Cl.
CPC ..... *F41B 5/1403* (2013.01)

(58) Field of Classification Search
CPC ..... F41B 5/00; F41B 5/10; F41B 5/12; F41B 5/14; F41B 5/1403
USPC ..... 124/23.1, 25, 25.6, 86
See application file for complete search history.

(56) References Cited

U.S. PATENT DOCUMENTS 5,172,679 A * 12/1992 Mussack ..... F41B 5/0052 124/88
5,280,779 A 1/1994 Smith
5,433,792 A * 7/1995 Darlington ..... F41B 5/0026 124/88
5,464,001 A * 11/1995 Peck ..... F41B 5/10 124/88
5,487,373 A * 1/1996 Smith ..... F41B 5/10 124/88
5,515,836 A * 5/1996 Martin ..... F41B 5/0026 124/88

(Continued)

FOREIGN PATENT DOCUMENTS

DE 202011107947.7 U1 2/2012
KR 20090054766 A 6/2009

(Continued)

OTHER PUBLICATIONS

Extended European Search Report for European Application No. 20169059.1 dated Sep. 30, 2020.

*Primary Examiner* — Alexander R Niconovich
(74) *Attorney, Agent, or Firm* — Dorsey & Whitney LLP

(57) ABSTRACT

An adjustable limb pocket of an archery bow includes a pocket insert having at least one channel that extends along a length of the pocket insert. The at least one channel can include a plurality of attachment positions. A limb contact member can be coupled to one of the plurality of attachment positions to support a bow limb retained within the limb pocket. One or more limb contact members can be repositionable within one or more channels of the pocket insert to vary a bowstring tension of the archery bow and/or manipulate the movement a distal tip of the bow limb as the bowstring is drawn and released. In some cases, one or more weights are positioned inside the limb pocket.

16 Claims, 15 Drawing Sheets

(56) References Cited

U.S. PATENT DOCUMENTS 5,720,267 A * 2/1998 Walk ..... F41B 5/10 124/23.1
5,722,380 A * 3/1998 Land ..... F41B 5/10 124/23.1
6,024,076 A * 2/2000 Laborde ..... F41B 5/0026 124/23.1
6,244,259 B1 * 6/2001 Adkins ..... F41B 5/0026 124/23.1
6,526,957 B1 * 3/2003 Leven ..... F41B 5/1426 124/89
6,543,432 B2 * 4/2003 Andrews ..... F41B 5/105 124/23.1
6,886,549 B2 * 5/2005 McPherson ..... F41B 5/0026 124/88
6,941,937 B2 * 9/2005 Wheeler ..... F41B 5/105 124/88
7,334,575 B2 * 2/2008 McPherson ..... F41B 5/0026 124/23.1
7,584,750 B2 * 9/2009 Chang ..... F41B 5/12 124/25
7,762,245 B2 7/2010 Smith et al.
7,784,452 B1 * 8/2010 Kronengold ..... F41B 5/10 124/23.1
7,832,387 B1 * 11/2010 Yehle ..... F41B 5/0094 124/23.1
8,047,189 B2 * 11/2011 McPherson ..... F41B 5/10 124/23.1
8,281,773 B2 * 10/2012 Dahl, II ..... F41B 5/1415 124/23.1
8,448,630 B1 * 5/2013 McPherson ..... F41B 5/00 124/25
8,453,635 B1 * 6/2013 McPherson ..... F41B 5/10 124/25
8,459,244 B2 * 6/2013 Yehle ..... F41B 5/0094 124/23.1
8,844,508 B2 * 9/2014 Sims ..... F41B 5/123 124/25
9,103,622 B2 * 8/2015 Park ..... F41B 5/1426
9,389,039 B2 * 7/2016 Denton ..... F41B 5/10
9,581,406 B1 * 2/2017 Nevels ..... F41B 5/0031
9,976,831 B2 * 5/2018 Badgerow ..... F41B 5/10
10,024,622 B1 7/2018 Boester
10,184,750 B2 1/2019 Mcpherson
10,883,791 B2 1/2021 Webster et al.
11,029,121 B2 * 6/2021 McPherson ..... F41B 5/10
11,274,899 B2 * 3/2022 Ell ..... F41B 5/1403
2002/0020403 A1 * 2/2002 Troubridge ..... F41B 5/1426 124/25
2002/0066446 A1 * 6/2002 Kesti ..... F41B 5/14 248/176.1
2002/0078939 A1 6/2002 Andrews et al.
2003/0084893 A1 5/2003 Andrews
2006/0011181 A1 * 1/2006 Andrews ..... F41B 5/1426 124/23.1
2008/0072888 A1 3/2008 Chang
2009/0145411 A1 6/2009 Sims et al.
2009/0241928 A1 * 10/2009 Blosser ..... F41B 5/0026 124/88
2012/0192843 A1 8/2012 Batdorf
2014/0041645 A1 2/2014 Wasilewski et al.
2015/0226511 A1 * 8/2015 Chang ..... F41B 5/1426 124/88
2016/0091273 A1 3/2016 Denton et al.
2017/0030674 A1 2/2017 Ell et al.
2018/0094897 A1 4/2018 Langley
2019/0301830 A1 * 10/2019 McPherson ..... F41B 5/1426
2020/0088492 A1 * 3/2020 Liu ..... F41B 5/10
2020/0141687 A1 * 5/2020 Romero ..... F41B 5/0031
2022/0074701 A1 * 3/2022 Sidebottom ..... F41B 5/1403

FOREIGN PATENT DOCUMENTS

KR 20100043869 A 4/2010
KR 20180117745 A 10/2018

* cited by examiner

ARCHERY BOW LIMB ADJUSTMENT SYSTEM

RELATED APPLICATION

This application is a continuation of U.S. patent application Ser. No. 16/403,960, filed on 6 May 2019, now U.S. Pat. No. 10,883,791, the disclosure of which is incorporated, in its entirety, by this reference.

TECHNICAL FIELD OF THE INVENTION

The present disclosure generally relates to limb pockets for archery bows and specifically relates to one or more repositionable limb contact members for archery bows.

BACKGROUND OF THE INVENTION

Archery is a sport in which an archer draws and releases a bowstring of an archery bow to launch an arrow or other projectile down-range. Like many other sports, adjustable and customizable archery equipment is desirable to better optimize and elevate the archer's performance. To this end, archers regularly tweak, tune, adjust, or otherwise manipulate their archery equipment to secure more accuracy and repeatability in shot placement.

The mechanism or assembly for retaining or securing a bow limb to a riser of an archery bow can be used to achieve accurate and repeatable performance by determining how the limb flexes or bends relative to the riser. Commonly, each bow limb is secured or retained within a respective limb pocket of the riser. The limb pockets can be configured to receive limb bolts (i.e., tiller bolts) and dovetail bolts that engage with the limb to position, support, and retain the limb within the limb pocket.

When the limb bolt is adjusted, a proximal end of the limb moves forward or backward relative to the riser. The "tiller" of an archery bow is the difference between the perpendicular distance from the upper limb to the string and the perpendicular distance from the lower limb to the string. Thus, rotating a threaded limb bolt (i.e., tiller bolt) alters the "tiller" of the archery bow. For example, an archer can rotate an upper limb bolt clockwise and rotate the lower limb bolt counter-clockwise to adjust the tiller of the archery bow. Consequently, this method of adjusting the tiller of the archery bow can impede the archer's ability to adjust the draw weight of the archery bow because each limb bolt can only undergo a limited number of rotations.

Bow limbs of many sizes and shapes can be coupled to the riser to accommodate the varied preferences of an archer. While an archer can manipulate shooting characteristics of his or her archery bow by replacing one pair of limbs with another pair of limbs, purchasing and transporting multiple pairs of limbs can be costly and inconvenient. Moreover, replacing the limbs of an archery bow can require an archer to change shooting technique and muscle memory in order to secure optimum performance from the new limbs.

In view of the foregoing and other issues, there is a need for improvements to archery equipment including limb support within limb pocket assemblies.

BRIEF SUMMARY OF THE INVENTION

According to an aspect of the present disclosure, an archery bow assembly is provided. The assembly can comprise a riser having a limb pocket. The assembly can also include a limb having a distal end extending away from the riser and a proximal end retained within the limb pocket of the riser. The proximal end of the limb can include a riser-facing surface and an outward-facing surface. The assembly can also include a limb contact member which is repositionable within the limb pocket and attachable to the limb pocket. The limb contact member can support the limb at one of a plurality of locations on the riser-facing surface of the limb. The limb contact member can be configured to vary a string tension of the archery bow assembly based on an attachment position of the limb contact member relative to the limb pocket.

The attachment position can be a first attachment position of a plurality of attachment positions within a channel defined by the limb pocket. The string tension of the archery bow assembly can be a first value when the limb contact member is attached to the limb pocket in a first attachment position and the string tension of the archery bow assembly can be a second value when the limb contact member is attached to the limb pocket in a second attachment position. The archery bow assembly can further comprise a second limb contact member. The second limb contact member can be repositionable within the limb pocket and attachable to the limb pocket. The second limb contact member can support the limb at one of a second plurality of locations on the riser-facing surface of the limb. The limb contact member and second limb contact member can be attachable to the limb pocket using a fastener.

The archery bow assembly can also include at least one shim positioned between the limb contact member and the limb pocket. The proximal end of the limb can be configured to receive at least one weight. The at least one weight can be at least partially concealed by the proximal end of the limb when the limb is retained within the limb pocket.

In another aspect of the disclosure, another archery bow assembly can comprise a string and a riser. The riser can include a handgrip portion and a limb pocket. The limb pocket can define a limb-facing surface having a channel. The assembly can also include a limb contact member configured to be retained within the channel. The limb contact member can be repositionable within the channel. The assembly can also include a limb having a distal end extending away from the riser and a proximal end retained within the limb pocket of the riser. The proximal end of the limb can define a riser-facing surface and an outward-facing surface. The limb contact member can support the riser-facing surface of the proximal end of the limb to vary a string tension of the archery bow assembly based on an attachment position of the limb contact member within the channel.

The channel can extend along a length of the limb pocket. The channel can comprise a plurality of attachment positions. The limb pocket can comprise a center plane. The channel can be a first channel and the limb-facing surface of the limb pocket can also include a second channel. The first and second channels can be positioned on opposite sides of the center plane of the limb pocket. The archery bow assembly can further include a second limb contact member. The second limb contact member can support the riser-facing surface of the proximal end of the limb. The second limb contact member can be configured to vary the string tension of the archery bow assembly based on a second attachment position of the second limb contact member within the second channel.

In another aspect of the disclosure, the archery bow assembly can comprise a string and a riser. The riser can include an adjustable limb pocket assembly. The adjustable limb pocket assembly can comprise a limb pocket having a limb-facing surface. The limb-facing surface can define a recess. The adjustable limb pocket assembly can also comprise a pocket insert. The pocket insert can define a pair of laterally spaced channels. The pocket insert can be receivable within the recess of the limb pocket. Each channel of the pair of laterally spaced channels can extend along a length of the pocket insert. Each channel can also include a plurality of attachment positions. The adjustable limb pocket assembly can also include a pair of limb contact members. Each limb contact member of the pair of limb contact members can be configured to removably couple to an attachment position of the plurality of attachment positions. The archery bow assembly can also include a limb having a distal end extending away from the riser and a proximal end retained within the limb pocket assembly. The proximal end of the limb can have a riser-facing surface and an outward-facing surface. Each limb contact member of the pair of limb contact members can contact a location on the riser-facing surface of the limb relative to the attachment position.

The pocket insert can include a protrusion configured to be received within the recess of the limb-facing surface. The pocket insert can define a dovetail track configured to receive a corresponding portion of a dovetail bolt extending from the riser-facing surface of the limb. The proximal end of the limb can include a notch configured to receive a portion of the limb bolt. The pocket insert can be receivable at a distal end of the limb pocket. The pair of limb contact members can comprise a first limb contact member and a second limb contact member. The first limb contact member can be positioned at a first distance from a distal end of the limb pocket and the second limb contact member can be positioned at a second distance from the distal end of the limb pocket. The first distance can be larger than the second distance.

In yet another aspect of the present disclosure, a method of tuning an archery bow is shown and described. The method can include providing a riser, a limb, and a limb contact member. The riser can have a limb pocket which defines a channel. The limb can have a distal end extending away from the riser and a proximal end retained at the limb pocket of the riser. The limb can have a riser-facing surface and an outward-facing surface. The limb contact member can be coupled at a first attachment position within the channel. The limb contact member can be configured to support the riser-facing surface of the limb. The method can include decoupling the limb contact member from the first attachment position within the channel. The method can also include coupling the limb contact member at a second attachment position within the channel.

The above summary of the present invention is not intended to describe each aspect of every implementation of the present invention. The figures and the detailed description that follow more particularly exemplify aspects of the disclosure.

BRIEF DESCRIPTION OF THE DRAWINGS

The accompanying drawings and figures illustrate a number of exemplary aspects and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

DETAILED DESCRIPTION OF THE INVENTION

Figure 1A:
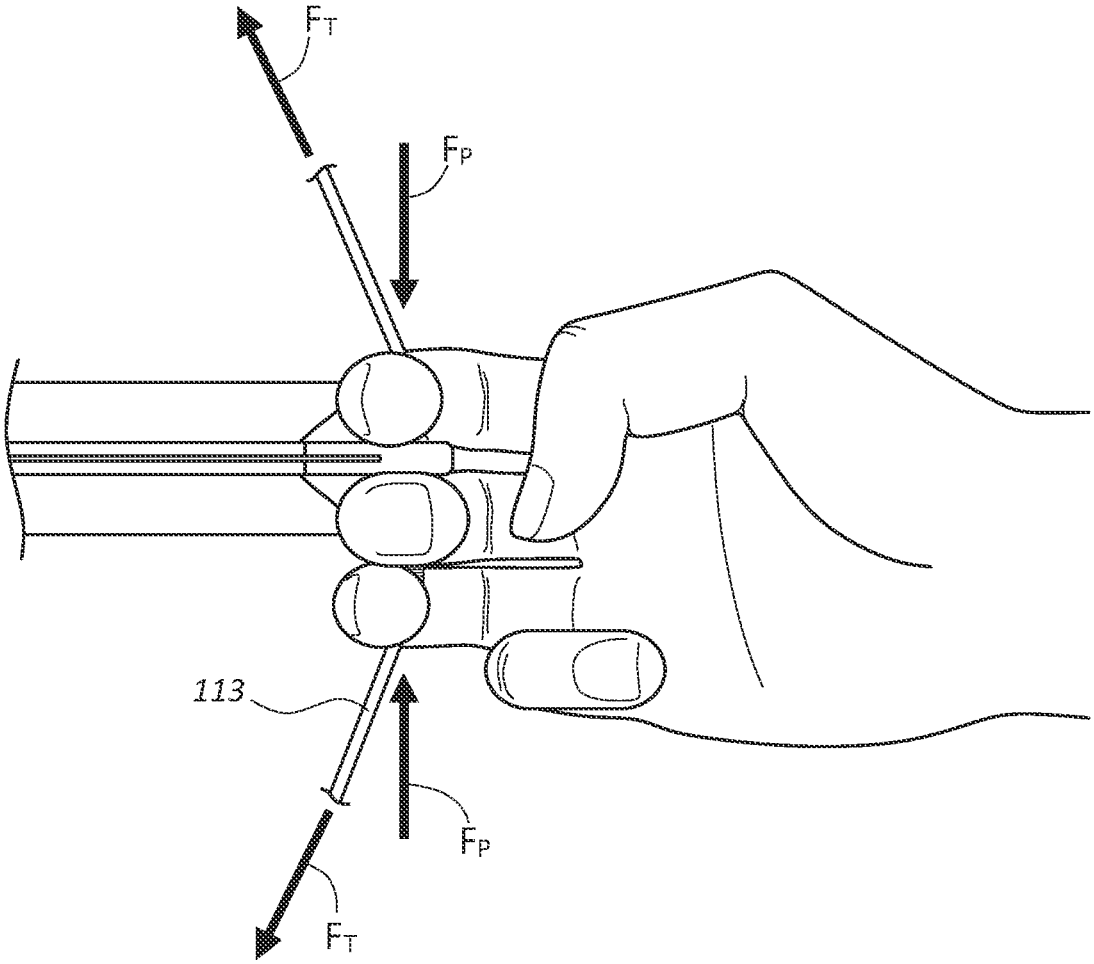
FIG. 1A depicts a side view of a hand of an archer maintaining a bow string in a drawn condition.

The present disclosure generally relates to apparatuses, methods, and assemblies for adjusting archery bow limbs. While drawing an archery bow, an archer pulls a bowstring away from the riser (e.g., direction $Z_1$ of FIG. 1A). The bowstring can extend between a set of limbs which deflect or otherwise bend relative to the riser when the bowstring is drawn and thereby store energy. This energy can then be transferred into a projectile (e.g., an arrow or bolt) removably coupled with the bowstring to launch the projectile downrange. The efficiency, accuracy, and repeatability of this launch process can largely depend on the manner in which each limb deflects relative to its respective limb pocket assembly. An archery bow having adjustable or otherwise repositionable limb contact members can improve the comfort, accuracy, and precision of an archer who uses the archery bow.

A limb can be supported or otherwise secured to a riser of an archery bow using a limb pocket assembly. The limb pocket assembly can include a plurality of components which retain a proximal end of a bow limb within a limb pocket of the riser. The limb pocket assembly can include a limb bolt and/or dovetail bolt configured to secure the proximal end of the limb to the limb pocket of the riser. The limb bolt can be any fastener or coupling mechanism used to locate or hold the proximal end of the limb to the pocket or riser. Similarly, the dovetail bolt can be any fastener used to locate an intermediate portion of the limb (e.g., a portion of the limb located between the proximal end and distal end of the limb) to the pocket or riser. In some aspects, the limb can be notched or slotted at its proximal end to receive a shaft of the limb bolt. The limb bolt can be threadably coupled with the limb pocket of the riser to permit draw weight adjustment. The limb can also include an aperture near a proximal end of the limb to receive a dovetail bolt. The dovetail bolt can include a protrusion which interlocks with a corresponding dovetail track within a riser-facing surface of the limb pocket.

Some archers, such as traditional archers and recurve archers, draw and release the bowstring by using their fingers to hold the bowstring. In other words, the archer hooks his or her fingertips around a portion of the bowstring to draw and release the bowstring (see FIG. 1A). Consequently, tension $F_T$ within the bowstring can influence how the archery bow feels or responds as the archer draws and holds the archery bow in a drawn position. String tension $F_T$ can induce a pinching force $F_P$ on the archer's fingers as the bow is drawn and released. This pinching force $F_P$ can influence or otherwise affect the archer's shooting mechanics or shooting routine. For example, the bowstring tension $F_T$ can affect the manner in which an archer draws an arrow through a clicker attached to a recurve bow. Similarly, bowstring tension $F_T$ can affect the manner in which an archer releases a bowstring from his or her fingers.

Many recurve archers rely on the length of each bow limb to achieve desired performance characteristics and attributes (e.g., a longer limb tends to support a longer draw length). By incorporating repositionable limb contact members within the limb pocket, an archer can purchase a medium length pair of limbs and use the repositionable limb contact members to effectively change the length of the limb to act as a longer or shorter pair of limbs. This can allow an archer to utilize a single pair of limbs and avoid needlessly purchasing and setting up additional pairs of limbs. Furthermore, replacing the limbs of an archery bow can alter shooting characteristics of the archery bow and therefore require the archer to modify his or her shooting mechanics to accommodate the new limbs which can negatively impact the archer's performance.

In one aspect of the disclosure, an adjustable limb pocket assembly can include a pair of limb contact members. The pair of limb contact members can be utilized to vary bowstring tension of an archery bow without significantly impacting a draw weight or other aspects of the archery bow. In one aspect, an archery bow can include at least one limb, a bowstring, and a riser having at least one adjustable limb pocket assembly. The adjustable limb pocket assembly can be configured to retain, secure, or otherwise support the limb within a limb pocket of the riser. The adjustable limb pocket assembly can include a pocket insert which removably couples to a recess within the limb pocket of the riser. The pocket insert can define a pair of channels configured to retain at least one limb contact member. As will be described in greater detail below, the position at which the limb contact member is retained within the channel can correlate to a change in the bowstring tension. For example, a limb contact member positioned near, or proximal to, a distal end of the limb pocket (as illustrated in FIG. 5B) can induce a particular bowstring tension, however, that particular bowstring tension can be varied or altered by repositioning the limb contact member within the channel. Indeed, the limb contact member can be repositioned away from or spaced from the distal end of the limb pocket (as illustrated in FIG. 5C) to effectively increase the portion of the limb which is permitted to bend as the bowstring is drawn and released, thereby varying the bowstring tension of the archery bow. By repositioning one or more limb contact members within the adjustable limb pocket assembly, an archer can manipulate the effective length of the limb which is permitted to flex and thereby vary the bowstring tension of his or her archery bow without substantially varying the draw weight of the archery bow.

In some aspects, an archery bow can include an upper pocket assembly and a lower pocket assembly. In this aspect, the upper pocket assembly can include a pair of limb contact members and the lower pocket assembly can also include a pair of limb contact members. An archer can reposition the upper and lower pair of limb contact members to vary the bowstring tension of the archery bow. For example, the upper limb contact members can be positioned near or proximal to the distal end of the upper limb pocket and the lower limb contact members can be positioned near or proximal to the distal end of the lower limb pocket. In this manner, the archer can effectively shorten the portion of each limb that can deflect while the bow is drawn and released. Varying or manipulating the portion of the limb which can deflect (i.e., the effective length of the limb) can change the bowstring tension without significantly impacting the draw weight of the archery bow (see FIG. 6E). Alternatively, the archer can reposition the upper limb contact members away from the distal end of the upper limb pocket and also reposition the lower limb contact members away from the distal end of the lower limb pocket. In this manner, the archer can effectively lengthen the portion of each limb that can deflect while the bow is drawn and released and thereby adjust the bowstring tension of bowstring without significantly impacting the draw weight of the archery bow.

Figure 8:
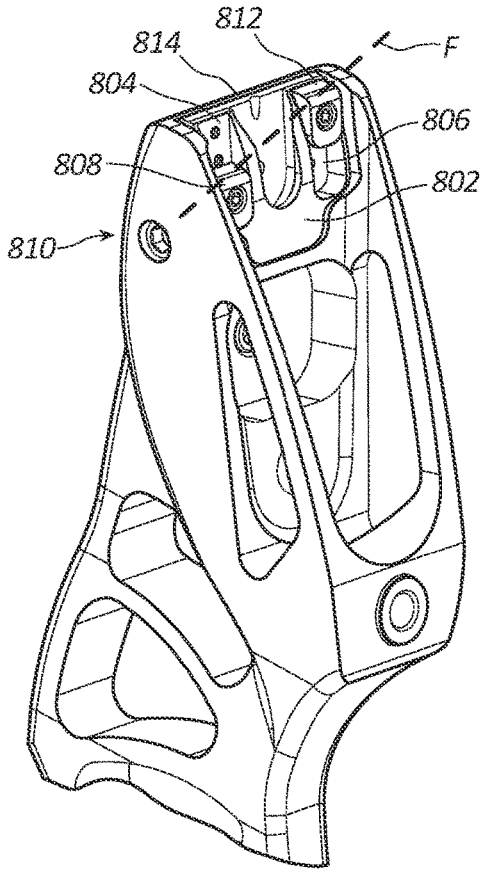
FIG. 8 depicts an isometric view of a limb pocket of a riser having a pocket insert and limb contact members positioned thereon.
Figure 9:
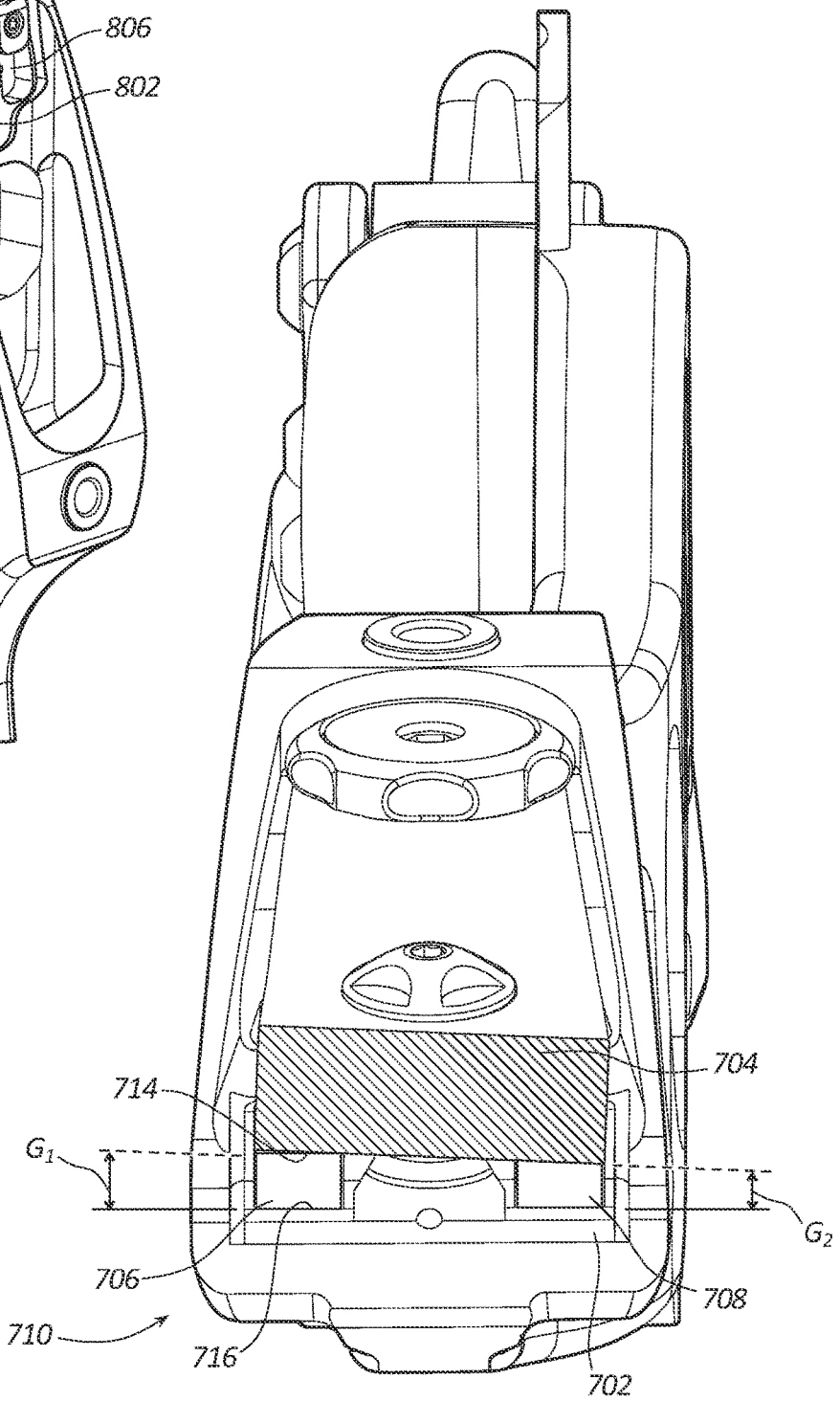
FIG. 9 depicts a top section view of the archery bow of FIG. 7A taken through lines 7-7 with repositioned limb contact members.

In another aspect of the disclosure, a pair of limb contact members can be positioned within a limb pocket to cause a bow limb to twist, pivot, or otherwise turn relative to the riser. In other words, the limb can be caused to twist, pivot, or turn about an axis that extends parallel to the longitudinal axis of the limb. Pivoting or otherwise turning a bow limb relative to the riser can allow an archer to manipulate travel or movement of a distal tip of the bow limb while the bowstring is drawn and released. In one aspect, an archery bow can include an upper limb, a lower limb, a bowstring, and a riser having upper and lower limb pocket assemblies (e.g., adjustable limb pocket assemblies). The upper limb pocket assembly can be configured to retain and support the upper limb within a limb pocket of the riser. The upper limb pocket assembly can include a pocket insert which removably couples to a recess within the limb pocket of the riser. The pocket insert can define a pair of channels configured to retain at least one limb contact member. As will be described in greater detail below, the position at which the limb contact member is retained within the channel can alter a location at which the limb contact member contacts and supports a riser-facing surface of the limb. For example, a first limb contact member can be positioned near or proximal to a distal end of the limb pocket while a second limb contact member can be positioned away from the distal end of the limb pocket (as illustrated in FIG. 8). The first and second limb contact members can contact and support first and second locations on a riser-facing surface of the limb, respectively. Because the first location is further from the proximal end of the limb than the second location, the first and second limb contact members can cause the limb to pivot or turn at an angle relative to the riser around the longitudinal axis of the limb (as depicted in FIG. 9). This limb angle relative to the riser can cause a distal tip of the bow limb to pivot or turn relative to the riser and thereby alter how the distal tip of the bow limb travels or moves when the archer draws and releases the bowstring.

In some aspects, the upper and lower limb pocket assemblies can include respective pocket inserts and limb contact members. In such aspects, the upper and lower limb pocket assemblies can be utilized to pivot or turn the upper and lower limbs at respective angles relative to the riser. Such adjustability can be utilized by skilled archers to tune their archery bow for increased accuracy, repeatability, and overall performance of the archery bow. For example, one or both of the limbs can be pivoted or turned such that a plane in which the bowstring travels is parallel to a plane that extends through a longitudinal axis of the riser.

In yet another aspect of the present disclosure, the pocket assembly can include one or more weights configured to be removably coupled within the limb pocket of the riser. In one aspect, an upper pocket assembly and a lower pocket assembly can each include a plurality of weights configured to be operably coupled within an upper limb pocket and/or a lower limb pocket of the riser. The plurality of weights can be configured to provide a balancing weight at the upper portion of the riser, the lower portion of the riser, or both. Archers can utilize the plurality of weights to tune how the riser responds to launching an arrow or other projectile from the archery bow. While the limbs are attached or otherwise retained within the limb pockets of the riser, one or more weights coupled to each of the limb pockets can be partially or entirely concealed by the limbs. For example, the one or more weights can be positioned within a recess in the limb-facing surface of the limb pocket which is wholly or partially concealed by the proximal end of the limb.

The present description provides examples, and is not limiting of the scope, applicability, or configuration set forth in the claims. Thus, it will be understood that changes may be made in the function and arrangement of elements discussed without departing from the spirit and scope of the disclosure, and various aspects may omit, substitute or add other procedures or components as appropriate. For instance, methods described may be performed in an order different from that described, and various steps may be added, omitted, or combined. Also, features described with respect to certain aspects may be combined in other aspects. In some cases, the present disclosure may be applied to compound bows, recurve bows, and traditional bows.

Figure 1B:
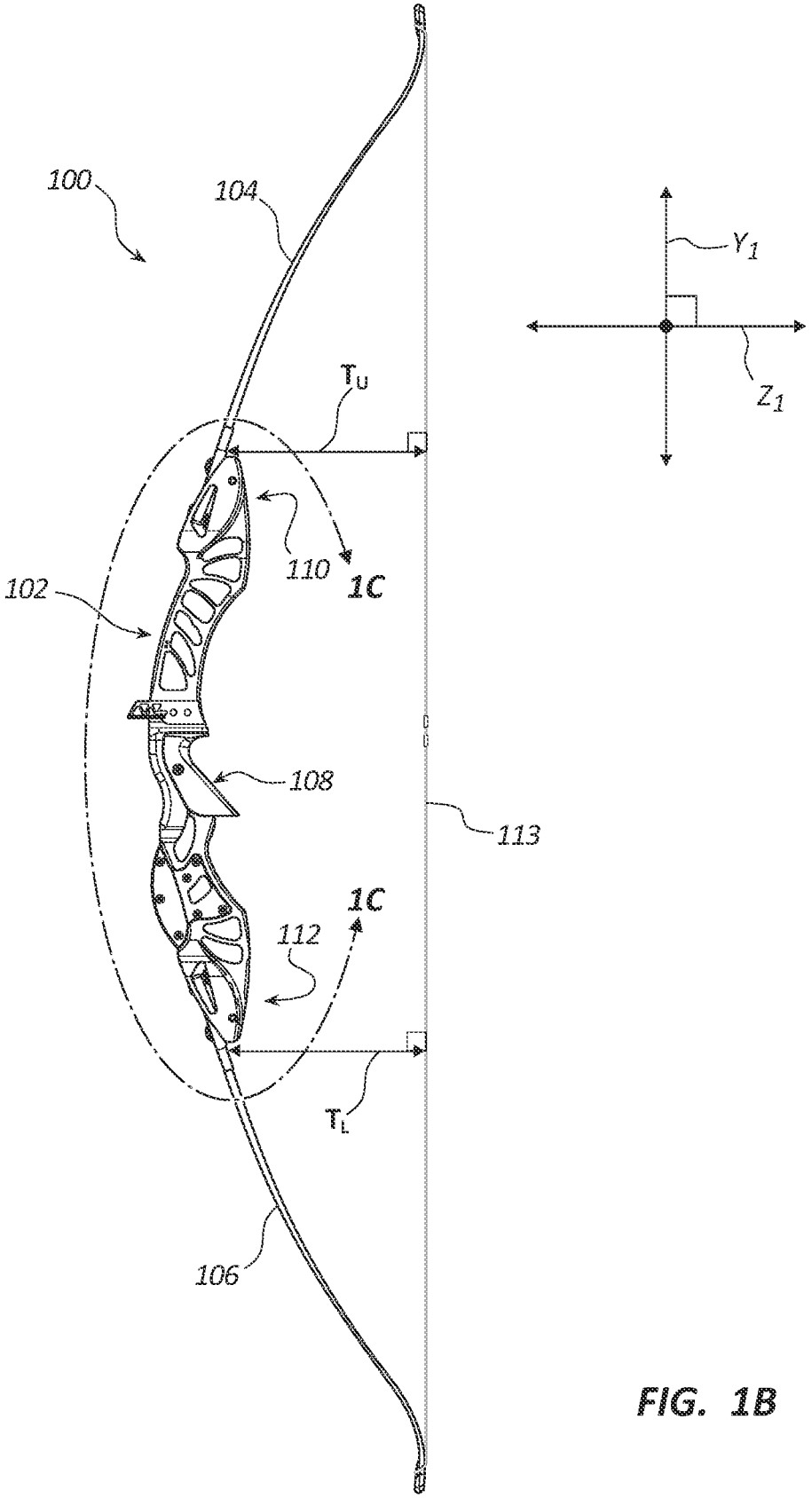
FIG. 1B depicts a side view of a recurve bow, according to an aspect of the present disclosure.
Figure 1C:
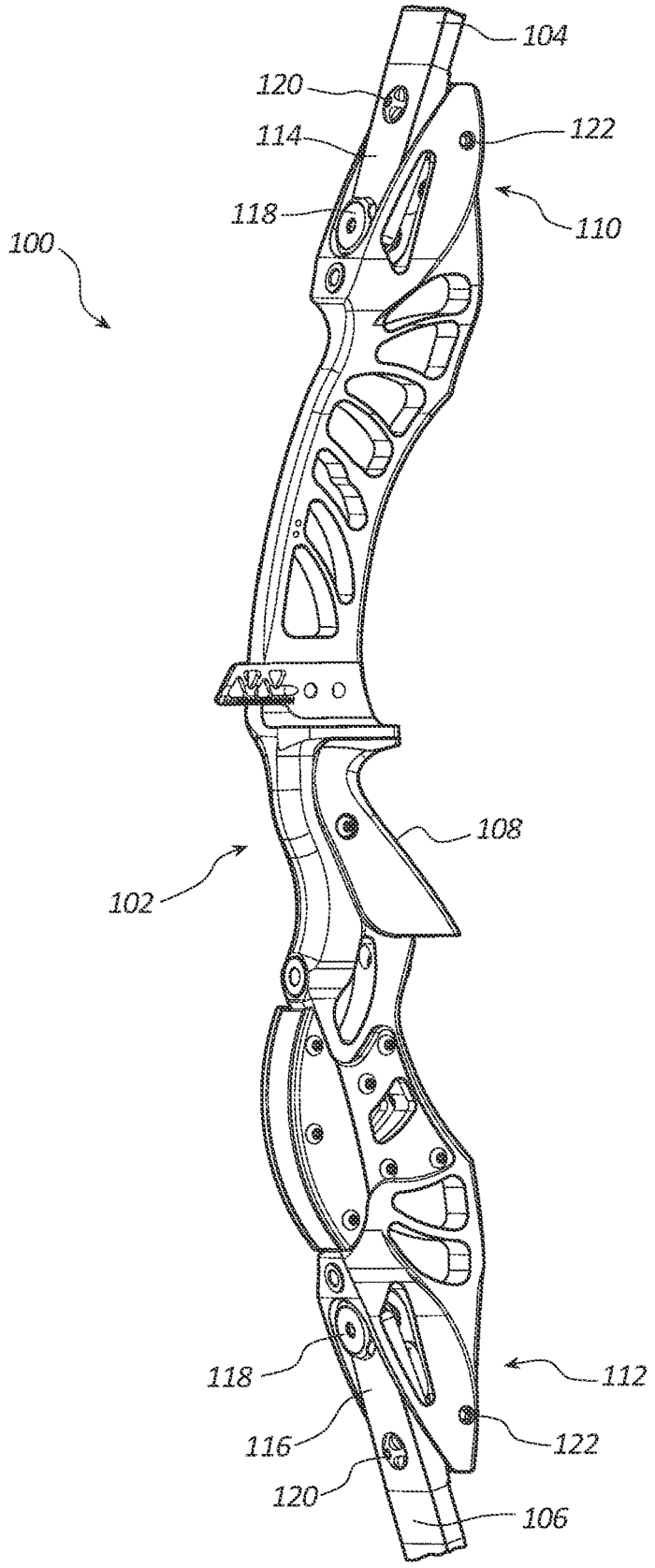
FIG. 1C depicts an enlarged isometric view of the archery bow 100 depicted in FIG. 1B.

FIG. 1B shows an example archery bow 100, which can include a riser 102 and upper and lower limbs 104, 106 mounted to the riser 102. The riser 102 can include a hand grip portion 108 and upper and lower limb pockets 110, 112. A bowstring 113 can extend between the upper limb 104 and the lower limb 106. The upper and lower limbs 104, 106 can be attached to upper and lower limb pockets 110, 112, respectively. The hand grip portion 108 can be generally centrally located between the upper and lower limb pockets 110, 112 of the riser 102. FIG. 1C the archery bow 100 of FIG. 1B with the upper limb pocket 110 configured to retain a proximal end 114 of the upper limb 104 using a limb bolt 118 and/or a dovetail bolt 120. Similarly, the lower limb pocket 112 can be configured to retain a proximal end 116 of the lower limb 106 using a limb bolt 118 and/or a dovetail bolt 120.

FIG. 1B also shows an upper tiller distance $T_U$ and a lower tiller distance $T_L$ relative to the upper limb 104 and the lower limb 106, respectively. The tiller of the archery bow is the difference between the upper tiller distance $T_U$ and a lower tiller distance $T_L$. In one embodiment, the tiller of the archery bow can be adjusted without rotating the limb bolts by utilizing a plurality of repositionable limb contact members, as described in further detail below.

Figure 2:
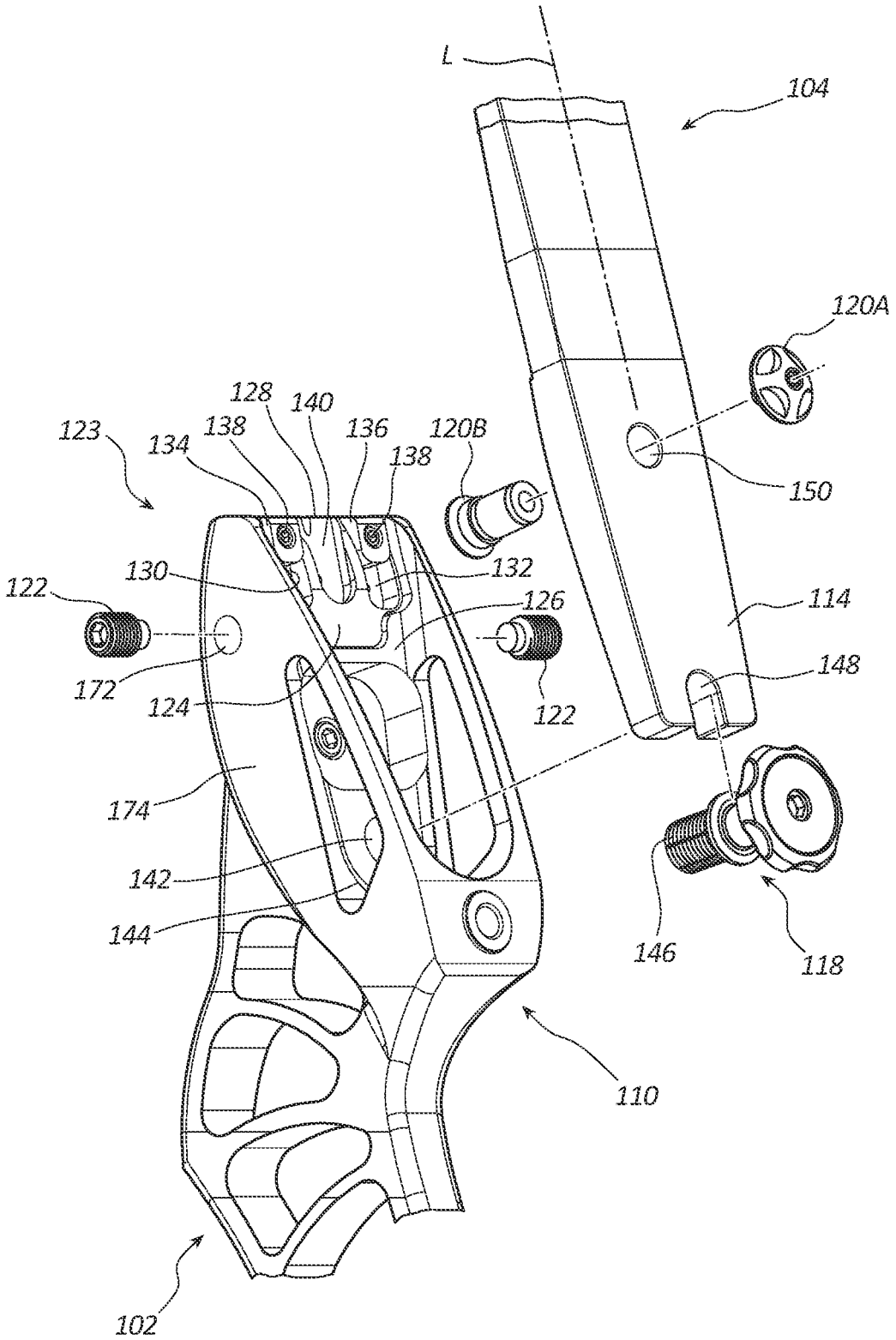
FIG. 2 shows an exploded isometric view of an upper portion of the archery bow of FIG. 1B.

FIG. 2 shows the archery bow 100 having an adjustable limb pocket assembly 123, which can include one or more of the components within the upper portion of the archery bow 100. For example, the adjustable limb pocket assembly 123 can include the limb pocket 110, the limb bolt 118, one or more set screws 122, a pocket insert 124, and one or more limb contact members 134, 136. In one aspect, the pocket insert 124 can be coupled, secured, or otherwise retained within a recess on the limb-facing surface 126 of the upper limb pocket 110. For example, the pocket insert 124 can be coupled at a distal end 128 of the limb pocket 110 using at least one set screw 122. The pocket insert 124 can form one or more channels 130, 132 extending along a length of the pocket insert 124 and abutting the distal end 128 of the upper limb pocket 110. The one or more limb contact members 134, 136 can be positioned within the channels 130, 132. For example, one or more fasteners 138 can be used to operably couple the limb contact members 134, 136 within the channels 130, 132. In other aspects, the pocket insert 124 can be omitted from the pocket assembly 123 and the channels 130,132 can be formed or defined within the limb-facing surface 126 of the limb pocket 110.

The pocket insert 124 can also form a dovetail track 140 configured to interlock, couple, or otherwise receive a lower portion 120B of the dovetail bolt 120 to retain the upper limb 104 within the upper limb pocket 110. The dovetail track 140 can be positioned proximal to or abutting the distal end 128 of the limb pocket 110. The dovetail track 140 can also be positioned between the channels 130, 132 and extend parallel with a longitudinal axis L which extends along a centerline of the limb 104.

The limb bolt 118 can be coupled to or received by a limb bolt aperture 142 positioned on a proximal end 144 of the limb pocket 110 to secure the limb 104 to the limb pocket 110. For example, the limb bolt 118 can include a threaded lower portion 146 which is threadably received within the limb bolt aperture 142 of the limb pocket 110. The limb 104 can comprise a slot or notch 148 at the proximal end 114 of the limb 104. The slot or notch 148 can be configured to engage with the limb bolt 118 to retain the limb 104 to the limb pocket 110. In some aspects the slot or notch 148 can permit the removal of the limb 104 from the limb pocket 110 without removing the limb bolt 118 from the limb bolt aperture 142. In some aspects, an archer can vary the weight required to pull the bowstring to a drawn condition (i.e., draw weight) by turning the limb bolt 118 relative to the limb bolt aperture 142.

The dovetail bolt 120 can include an upper portion 120A and a lower portion 120B. The upper portion 120A can be coupled or otherwise attached to the lower portion 120B. For example, the upper portion 120A can be threadably attached to the lower portion 120B. Moreover, the upper and lower portions 120A, 120B of the dovetail bolt 120 can extend through a dovetail aperture 150 within the proximal end 114 of the limb 104. Coupling the upper portion 120A to the lower portion 120B can generate a clamping force relative to the limb 104 and thereby retain the dovetail bolt 120 within the dovetail aperture 150 of the limb 104.

Figure 3A:
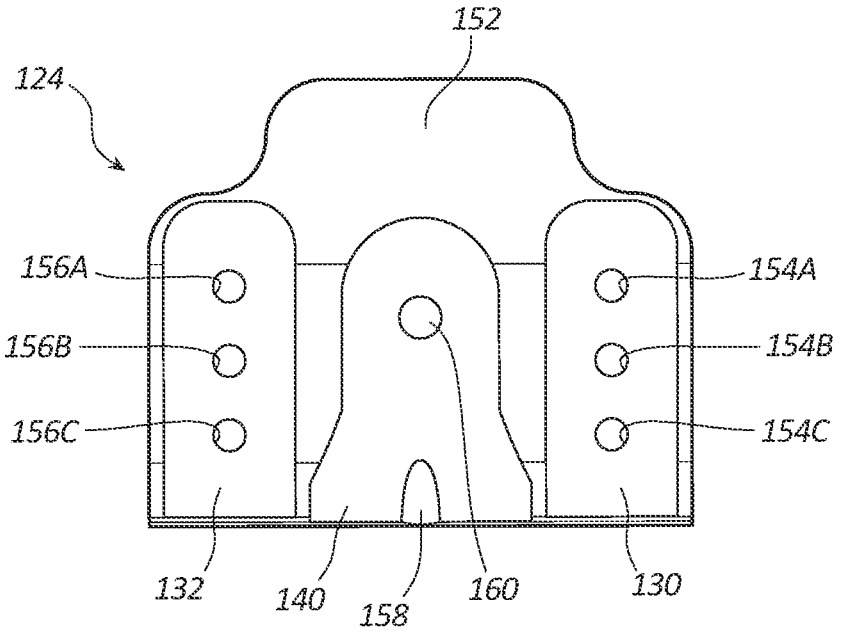
FIG. 3A depicts a top view of a pocket insert, according to an aspect of the present disclosure.
Figure 3B:
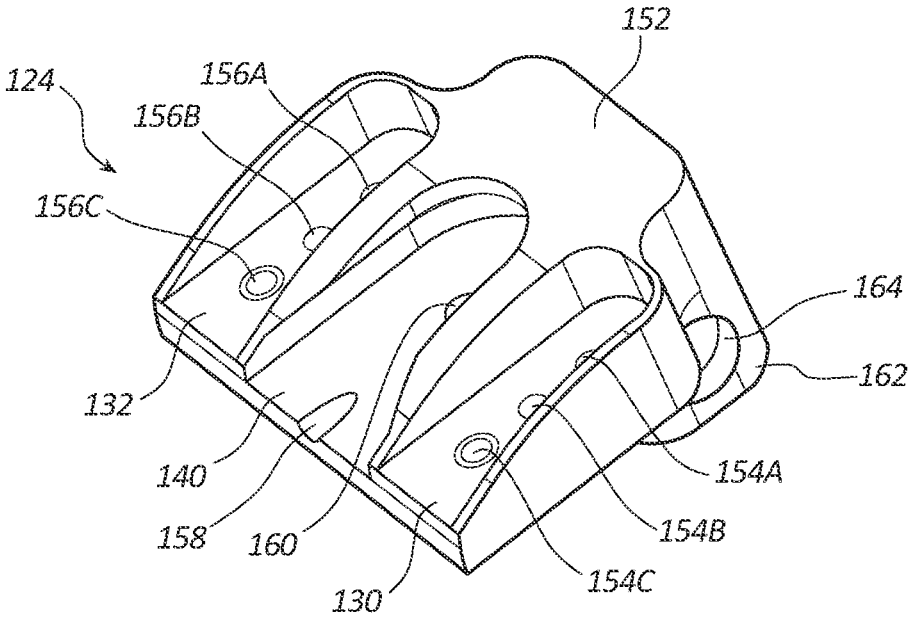
FIG. 3B depicts an isometric view of a pocket insert, according to an aspect of the present disclosure.

FIGS. 3A and 3B show a pocket insert 124, which can include one or more channels 130, 132 formed, machined, or otherwise defined within a limb-facing surface 152 of the pocket insert 124. The one or more channels 130, 132 can include a first channel 130 and second channel 132 which each span a length of the pocket insert 124. The first channel 130 can extend substantially parallel to the second channel 132. In some aspects, the first channel 130 can be laterally spaced from the second channel 132. The first and second channels 130, 132 can be configured to receive first and second limb contact members 134, 136, respectively. While the example aspect depicted in FIGS. 3A and 3B have two channels (e.g., first and second channels 130, 132), other aspects of the pocket insert 124 can include a single channel or more than two channels. Additionally or alternatively, a single limb contact member can be configured to contact a plurality of channels simultaneously. For example, end portions of the single limb contact member can be received within the first and second channels 130, 132 and a middle portion of the single limb contact member can span between the first and second channels 130, 132.

The first and second channels 130, 132 can include a plurality of attachment positions 154A-C, 156A-C within the channels 130, 132. In some aspects, each of the attachment positions 154A-C can be configured to retain the first limb contact member 134 in a particular location relative to the first channel 130. In one aspect, the attachment positions 154A-C include a plurality of distinct attachment positions evenly positioned along a length of the first channel 130. In another aspect, the attachment positions 154A-C can define an attachment track configured to provide an infinite number of attachment positions spanning a length of the first channel 130. Similarly, each of the attachment positions 156A-C can be configured to retain the second limb contact member 136 in a particular location relative to the second channel 132. In one aspect, the attachment positions 156A-C include a plurality of distinct attachment positions evenly positioned along a length of the second channel 132. In another aspect, the attachment positions 156A-C can define an attachment track configured to provide an infinite number of attachment positions spanning a length of the second channel 132. The attachment positions 154A-C, 156A-C can be threaded apertures, wherein each aperture is configured to receive a fastener (e.g., fastener 138).

The pocket insert 124 can also include a dovetail track 140 formed, machined, or otherwise defined on the limb-facing surface 152 of the pocket insert 124. The dovetail track 140 can be configured to receive and interlock with the dovetail bolt 120 to secure the limb 104 to the limb pocket 110. The dovetail track 140 can include a protrusion guide 158 configured to receive and depress a biased protrusion extending from the dovetail bolt 120 as the dovetail bolt 120 is inserted into the dovetail track 140. The dovetail track 140 can also include a recess 160 configured to receive the biased protrusion extending from the dovetail bolt 120 to secure or otherwise retain the dovetail bolt 120 within the dovetail track 140.

The pocket insert 124 can also include a pocket insert protrusion 162 having one or more pocket insert through-holes 164. The pocket insert protrusion 162 can extend in a direction generally perpendicular to the limb-facing surface 152 of the pocket insert 124. The pocket insert protrusion 162 can be received within a protrusion recess 168 formed within an insert recess 166 on the limb-facing surface 126 of the limb pocket 110 (see FIGS. 4A and 4B). The pocket insert through-hole 164 can receive a portion of the set screw 122 to retain the pocket insert 124 within the limb pocket 110.

Figure 3C:
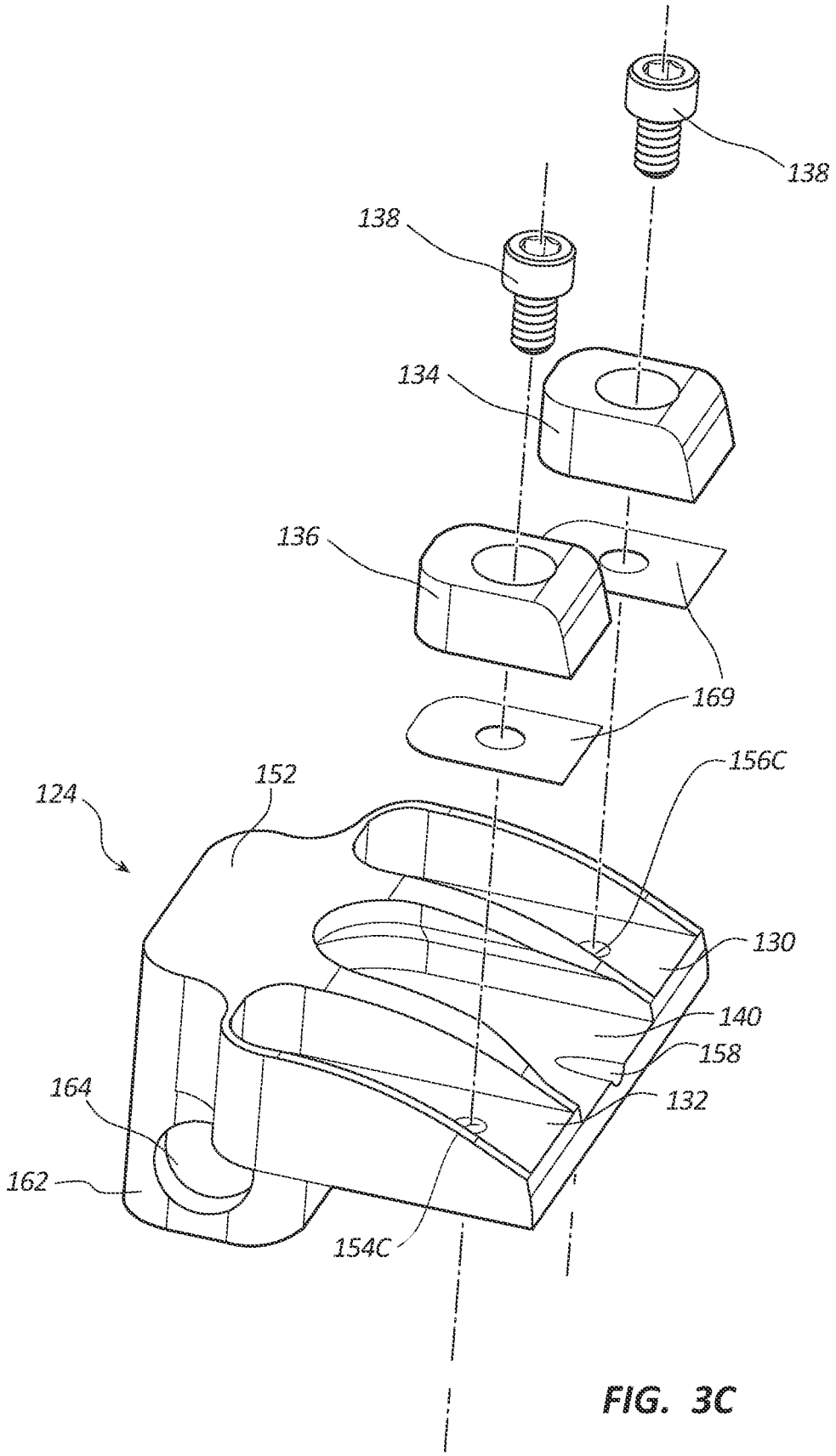
FIG. 3C depicts an exploded isometric view of a pocket insert, limb contact members, and shims, according to an aspect of the present disclosure.

FIG. 3C shows a pocket insert 124, limb contact members 134, 136, and shims 169, according to one aspect of the present invention. One or more fasteners 138 can be used to operably couple multiple limb contact members 134, 136 within respective channels 130, 132 of the pocket insert 124. In some aspects, the fasteners 138 can also be used to operably couple one or more shims 169 to the pocket insert 124. For example, one or more shims 169 can be positioned between the first limb contact member 134 and the first channel 130 of the pocket insert 124. Similarly, one or more shims 169 can be position between the second limb contact member 136 and the second channel 132 of the pocket insert 124. The shims 169 can be thin plates held in place within one of the channels 130, 132 of the pocket insert 124 by pressure applied by one of the fasteners 138 which extend through an opening or slot in each shim 169. In other aspects, where the pocket insert 124 is omitted, the channels can be formed directly within the limb pocket and one or more shims 169 can be positioned between the limb contact member and the limb pocket (e.g., a channel formed on a surface of the limb pocket).

In some aspects, the quantity or thickness of the shims 169 positioned under each respective limb contact member 134, 136 can be utilized to adjust the travel of a distal tip of the limb as the bowstring is drawn and released. For example, multiple shims or a thicker shim 169 can be positioned under the first limb contact member 134 while fewer shims or a thinner shim 169 is positioned under the second limb contact member 136, thereby creating an angle relative to the riser-facing surface of the limb and the distal end of the limb pocket (see FIG. 9). By positioning a greater number of shims or a thicker shim 169 under the first limb contact member 134 than the second limb contact member 136, the limb can be forced to twist, pivot, or otherwise turn relative to a longitudinal axis of the limb (e.g., longitudinal axis L depicted in FIG. 2). Thus, the distal tip or end of the limb can be tuned or adjusted to travel or move as desired by the archer (e.g., tuned or adjusted to travel in a straight line while the bowstring is drawn and released). In other aspects, multiple shims or a thicker shim 169 can be positioned under the second limb contact member 136 while fewer shims or a thinner shim 169 is positioned under the first limb contact member 134. In yet other aspects, an equal number of shims 169 can be positioned under each of the first and second limb contact members 134, 136.

Figure 4A:
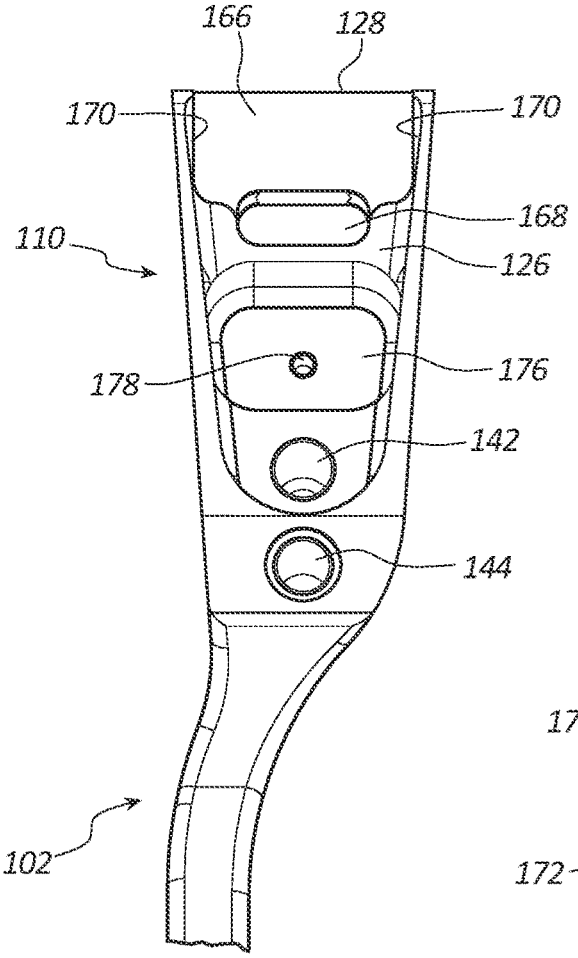
FIG. 4A depicts a front view of a limb pocket of a riser, according to an aspect of the present disclosure.
Figure 4B:
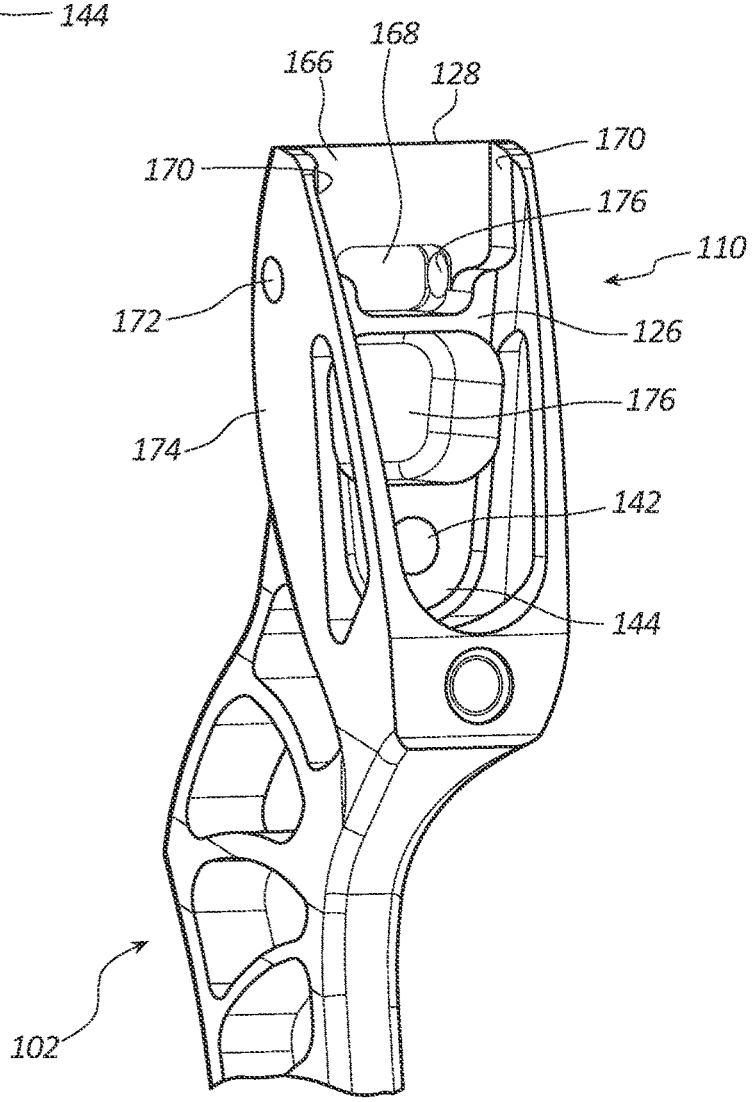
FIG. 4B depicts an isometric view of a limb pocket of a riser, according to an aspect of the present disclosure.

FIGS. 4A and 4B depict another example aspect of the disclosure where a limb pocket 110 of the riser 102 can include an insert recess 166 positioned near a distal end 128 of the limb pocket 110. The insert recess 166 can be configured to receive the pocket insert 124 within the limb pocket 110. The insert recess 166 can define a protrusion recess 168 and outer walls 170. In some aspects, the insert recess 166 can retain the pocket insert 124 such that the limb-facing surface 152 of the pocket insert 124 remains flush or aligned with the limb-facing surface 126 of the limb pocket 110. The protrusion recess 168 can extend perpendicular to the limb-facing surface 126 of the limb pocket 110. The protrusion recess 168 can be configured to receive at least a portion of the pocket insert protrusion 162 of the pocket insert 124. At least one set screw 122 can be used to secure the pocket insert 124 within the insert recess 166. For example, one or more set screws 122 can be threadably received within riser through-holes 172 extending through one or more sides 174 of the limb pocket 110. The riser through-holes 172 can align with the pocket insert through-holes 164 while the pocket insert 124 is positioned within the insert recess 166 of the limb pocket 110.

Figure 5A:
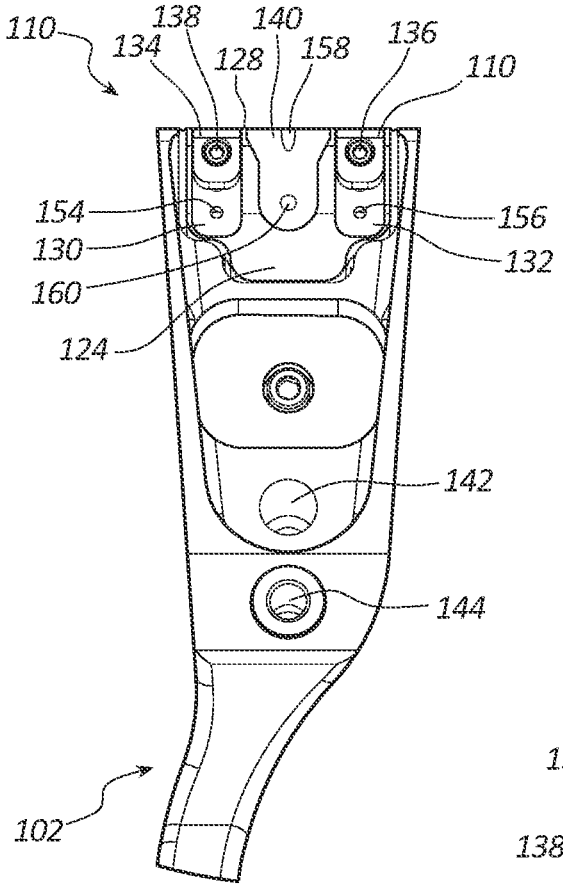
FIG. 5A depicts a front view of a limb pocket having repositionable limb contact members, according to an aspect of the present disclosure.
Figure 5B:
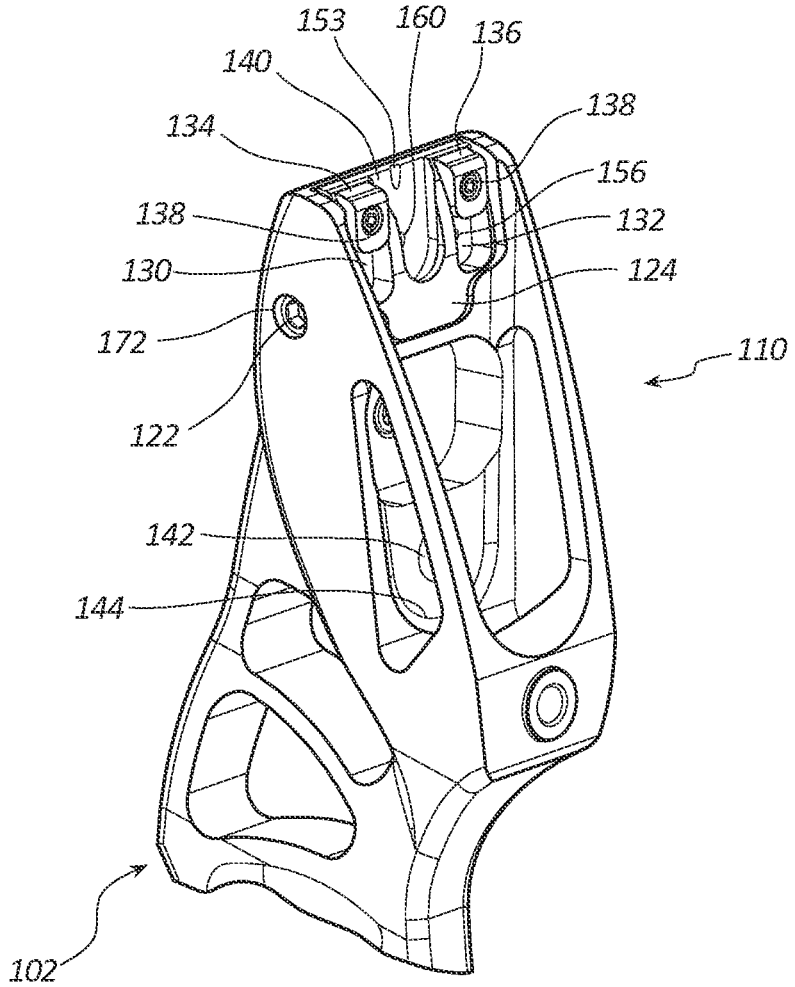
FIG. 5B depicts an isometric view of a limb pocket having repositionable limb contact members, according to an aspect of the present disclosure.
Figure 5C:
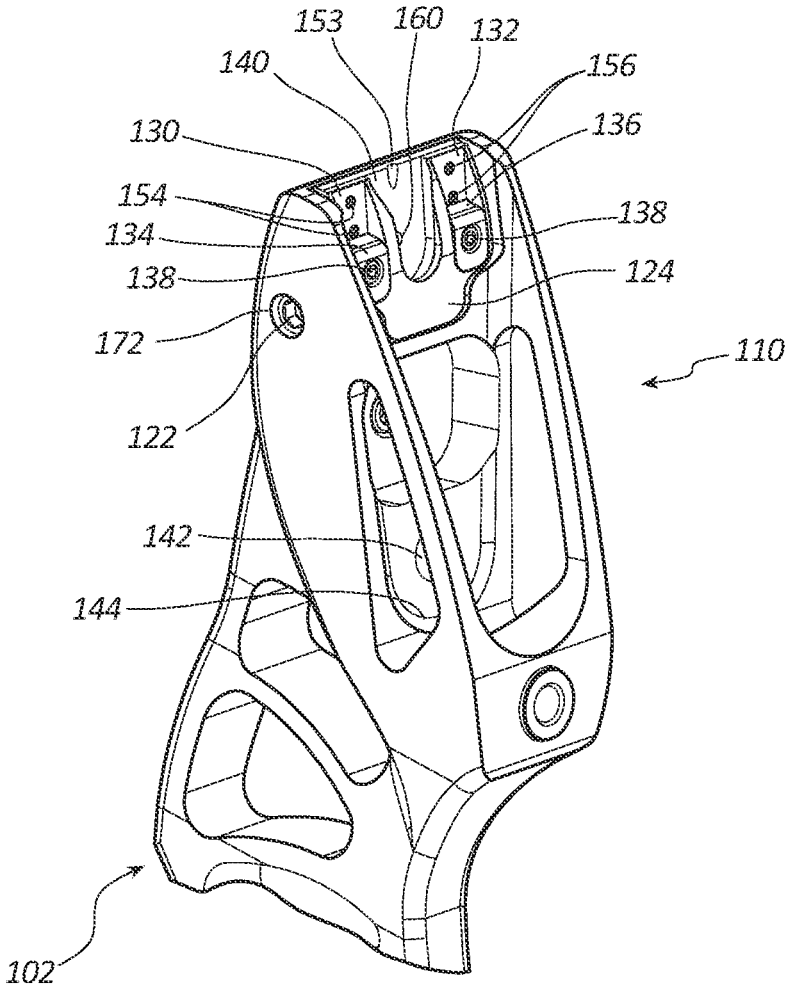
FIG. 5C depicts an isometric view of a limb pocket having repositionable limb contact members, according to another aspect of the present disclosure.

FIGS. 5A-C depict the limb pocket 110 having repositionable limb contact members 134, 136, according to the present disclosure. The limb pocket 110 can include the pocket insert 124 coupled to the first limb contact member 134 and the second limb contact member 136. The first limb contact member 134 can be positioned within a first channel 130. More specifically, the first limb contact member 134 can be retained at one of a plurality of attachment positions 154 within the first channel 130. Each attachment position 154 can retain the first limb contact member 134 in a particular location relative to the channel 130. In one aspect of the disclosure, the attachment positions 154 include a plurality of distinct attachment positions evenly positioned along a length of the channel 130. Similarly, the second limb contact member 136 can be positioned within a second channel 132. More specifically, the second limb contact member 136 can be retained at one of a plurality of attachment positions 156 within the second channel 132. Each attachment position 156 can retain the second limb contact member 136 in a particular location relative to the channel 132.

As depicted in FIGS. 5A and 5B, the first and second limb contact members 134, 136 can be positioned proximal to or near the distal end 128 of the limb pocket 110. In other words, the first and second channels 130, 132 can include attachment positions 154, 156 which retain each of the limb contact members 134, 136 at locations which abut the distal end 128 of the limb pocket 110. Alternatively, as depicted in FIG. 5C, the first and second limb contact members 134, 136 can be positioned or repositioned within each respective channel 130, 132 spaced from the distal end 128 of the limb pocket 110. When a bowstring is coupled to the archery bow (e.g., the archery bow 100 of FIG. 1), the limb 104 can be forced to bend or flex about the first and second limb contact members 134, 136. In a drawn condition, the bowstring can exhibit a particular bowstring tension relative to the respective attachment positions (e.g., 154A-C and 156A-C of FIG. 3A) of the first and second limb contact members 134, 136 within the first and second channels 130, 132. In other words, the bowstring tension induced by the respective attachment positions of the first and second limb contact members 134, 136 depicted in FIGS. 5A and 5B will not be the same as the bowstring tension induced by the respective attachment positions of the first and second limb contact members 134, 136 depicted in FIG. 5C. However, adjusting the attachment position of the first and second limb contact members 134, 136 relative to the limb pocket 110 may not substantially alter the draw weight of the archery bow.

Figure 6A:
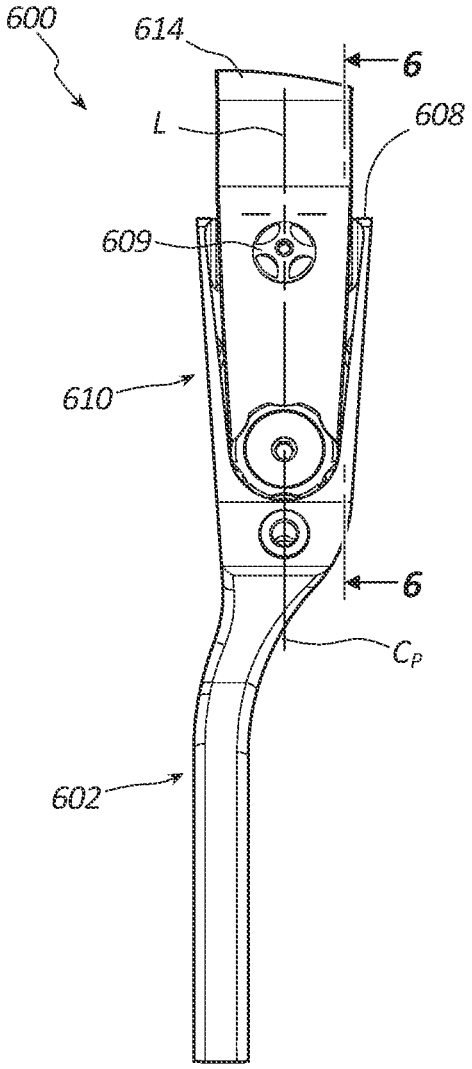
FIG. 6A depicts a front view of an upper portion of an archery bow.

FIG. 6A depicts an upper portion 600 of an archery bow according to the present disclosure. The upper portion 600 can include a riser 602, a limb pocket 610, and a limb 614. The limb 614 can define a longitudinal axis L which coincides with a centerline of the limb 614. The longitudinal axis L can intersect a dovetail bolt 609 removably coupled to the limb 614. In some aspects of the present disclosure, the longitudinal axis L of the limb 704 can be aligned with a center plane $C_p$ of the limb pocket 610.

Figures 6B, 6C, 6D:
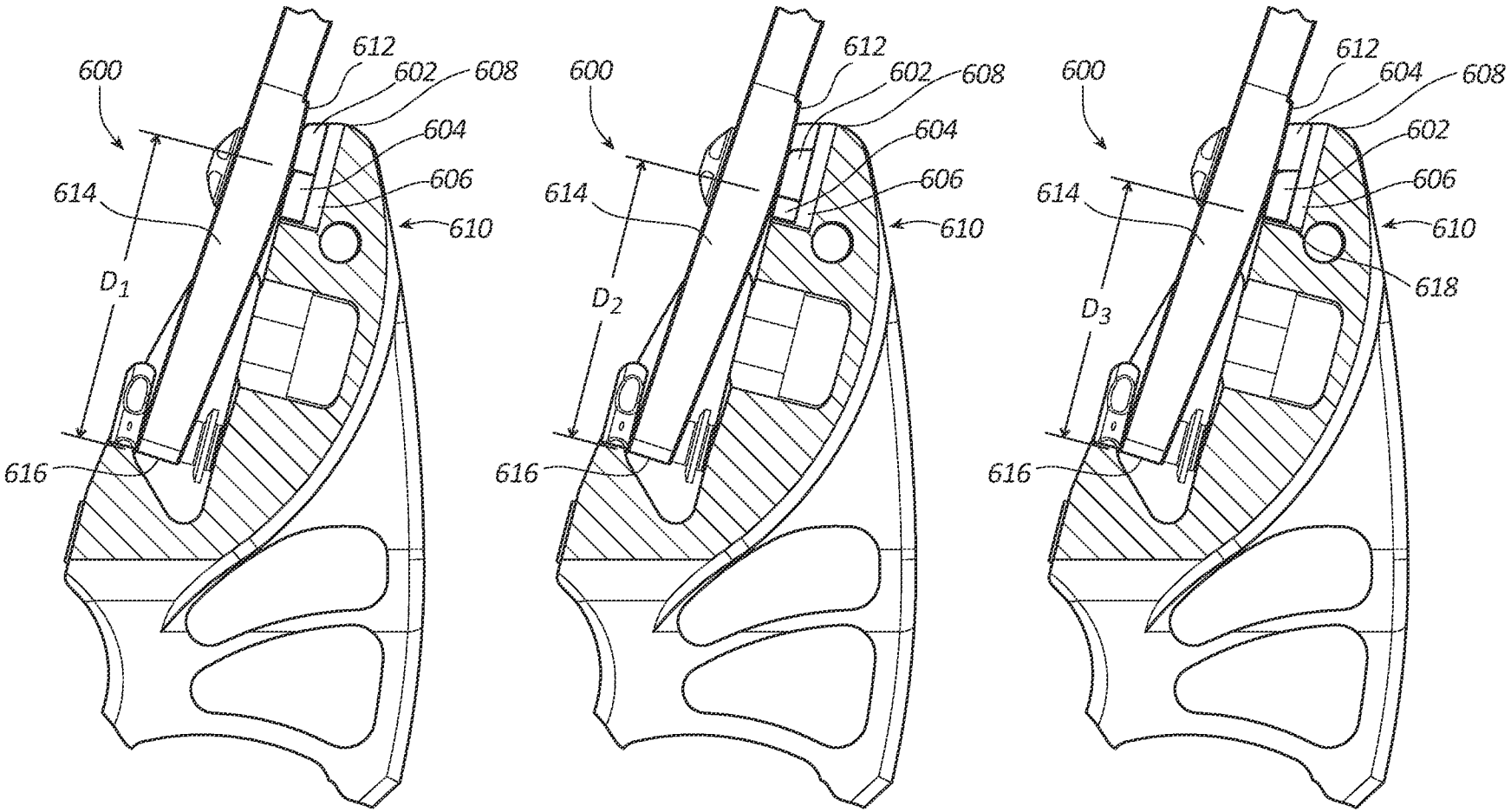
FIG. 6B depicts a side section view of an upper portion of an archery bow with the limb contact members in a first position, where the section is taken through lines 6-6 in FIG. 6A.
FIG. 6C depicts a side section view of an upper portion of an archery bow with the limb contact members in a second position, where the section is taken through lines 6-6 in FIG. 6A.
FIG. 6D depicts a side section view of an upper portion of an archery bow with the limb contact members in a third position, where the section is taken through lines 6-6 in FIG. 6A.
Figure 6E:
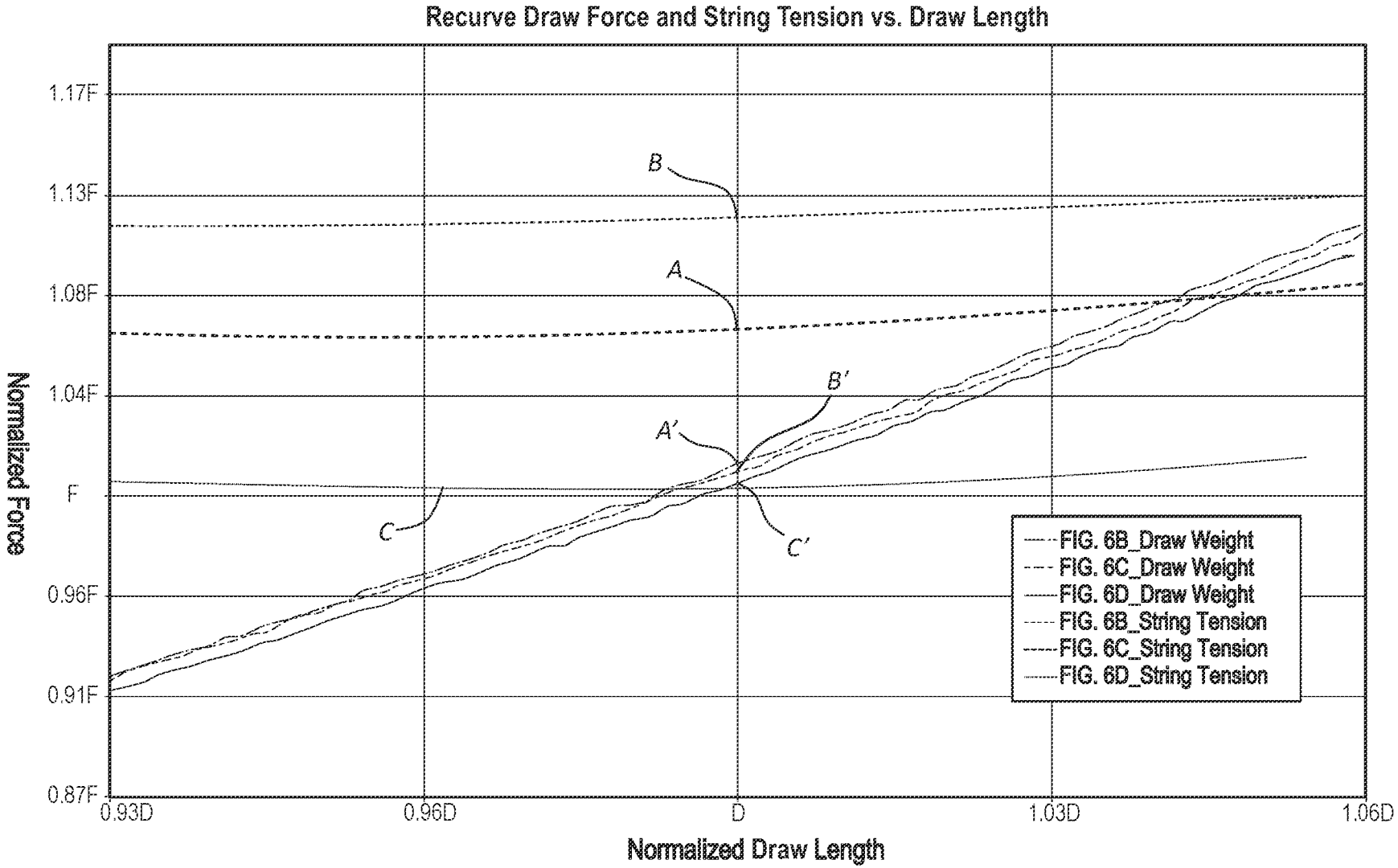
FIG. 6E depicts a graphical illustration showing the resultant bowstring tension and draw weight associated with each example aspect depicted in FIGS. 6B-D.

FIGS. 6B-D each depict a cross section view of an archery bow taken through the lines 6-6 in FIG. 6A. FIGS. 6B-D also illustrate example aspects of an archery bow having repositionable limb contact members, according to the present disclosure. FIG. 6E shows a graphical illustration depicting the normalized resultant bowstring tension and normalized draw weight associated with each example aspect depicted in FIGS. 6B-D.

FIG. 6B depicts a section view of one aspect of the disclosure of an upper portion 600 of an archery bow. A limb contact member 602 can be positioned within a channel 604 of a pocket insert 606. More specifically, the limb contact member 602 is coupled to an attachment position which locates the limb contact member 602 proximal to or near the distal end 608 of the limb pocket 610. FIG. 6C depicts a section view of another aspect of the disclosure showing an upper portion 600 of an archery bow. In this aspect of the disclosure, the limb contact member 602 is repositioned within the channel 604 of the pocket insert 606. More specifically, the limb contact member 602 is coupled to an attachment position which locates the limb contact member 602 at a midpoint of the channel 604 and spaces the limb contact member 602 away from the distal end 608 of the limb pocket 610. FIG. 6D depicts a section view of yet another aspect of the disclosure of an upper portion 600 of an archery bow. In this aspect, the limb contact member 602 is yet again repositioned within the channel 604 of the pocket insert 606. More specifically, the limb contact member 602 is coupled to an attachment position which locates the limb contact member 602 at an end 618 of the channel 604 and spaced furthest from the distal end 608 of the limb pocket 610.

Referring to FIG. 6B, the limb contact member 602 can be positioned to contact a riser-facing surface 612 of a limb 614 at a distance $D_1$ from a proximal end 616 of the limb 614. In other words, the limb contact member 602 can be coupled to an attachment position (e.g., attachment position 156C of FIG. 3A) which causes the limb contact member 602 to contact the riser-facing surface 612 of the limb 614 at a distance $D_1$ from the proximal end 616 of the limb 614. As illustrated by FIGS. 6B-D, the distance $D_1$ differs in length from the distances associated with other attachment positions within the channel 604. In some aspects of the disclosure, changing the distance between the proximal end 616 of the limb 614 and the location at which the limb contact member 602 contacts the riser-facing surface 612 of the limb 614 alters the length of the limb 614 which is permitted to flex or bend as the bowstring is drawn and released by the archer. Thus, altering or repositioning the attachment position of the limb contact member 602 can effectively change the length of the limb 614 which can respond, flex, or otherwise bend while the bowstring is drawn and released by the archer. Moreover, altering the effective length of the limb, as described above, can vary the tension of a bowstring without significantly impacting the draw weight of the archery bow (e.g., the change in draw weight is less than 1-2%).

Although only one limb pocket 610 (e.g., an upper limb pocket) is depicted in FIGS. 6A-D, it should be appreciated that a second limb pocket (e.g., a lower limb pocket) can also include one or more limb contact members configured to be repositionable relative to a plurality of attachment positions within the second limb pocket. Regarding FIG. 6E, a pair of limb contact members were positioned within an upper limb pocket and another pair of limb contact members were positioned in a lower limb pocket of an archery bow. As one example, the limb contact members were positioned within each limb pocket (i.e., the upper and lower limb pockets) as described in FIGS. 6B-D and subsequent force measurements were recorded and normalized. To normalize the measurements, the force measurements were divided by 46 lbs. and draw length measurements were divided by 30 inches. Thus, D represents 100% of 30 inches and F represents 100% of 46 lbs. The foregoing description of the recorded force measurements at each attachment position is exemplary only, and should not be considered to limit the scope, applicability, or configuration of what is recited in the appended claims.

FIG. 6E shows a graphical illustration of the resultant bowstring tension and draw weight associated with each example aspect depicted in FIGS. 6B-D. In other words, FIG. 6E depicts the resultant normalized bowstring tension and normalized draw weight associated with each of the attachment positions depicted in FIGS. 6B-D. String tension measurements were recorded in pounds relative to a draw length to which the archery bow was drawn. Similarly, draw weight measurements were recorded in pounds relative to a draw length to which the archery bow was drawn. The plot lines depicted in FIG. 6E demonstrate that the tension of an archery bowstring can be altered without significantly altering the draw weight of the archer bow by adjusting or repositioning one or more limb contact members relative to the proximal end of the limb pocket.

Regarding the attachment position depicted in FIG. 6B, wherein the limb contact member is positioned distance $D_1$ from the proximal end 616 of the limb 614, the bowstring tension measured 1.07 F of force at D inches of draw length (see reference letter A on FIG. 6E). Regarding the attachment position depicted in FIG. 6C, wherein the limb contact member is positioned distance $D_2$ from the proximal end 616 of the limb 614, the bowstring tension measured 1.12 F of force at D inches of draw length (see reference letter B on FIG. 6E). Regarding the attachment position depicted in FIG. 6D, wherein the limb contact member is positioned distance $D_3$ from the proximal end 616 of the limb 614, the bowstring tension measured 1.00 F of force at D inches of draw length (see reference letter C on FIG. 6E). As illustrated in FIG. 6E, the string tension of the archery bow was adjustable to vary from 1.12 F to 1.00 F, a difference of 12%. Thus, an archer can vary the bowstring tension of his or her archery bow by adjusting or repositioning one or more limb contact members relative to the limb pocket.

Regarding the attachment position depicted in FIG. 6B, wherein the limb contact member is positioned distance $D_1$ from the proximal end 616 of the limb 614, the draw weight measured 1.02 F lbs. of force at D inches of draw length (see reference letter A' on FIG. 6E). Regarding attachment position depicted in FIG. 6C, wherein the limb contact member is positioned distance $D_2$ from the proximal end 616 of the limb 614, the draw weight measured 1.01 F lbs. of force at D inches of draw length (see reference letter B' on FIG. 6E). Regarding attachment position depicted in 6D, wherein the limb contact member is positioned distance $D_3$ from the proximal end 616 of the limb 614, the draw weight measured 1.00 F of force at D inches of draw length (see reference letter C' on FIG. 6E). As illustrated in FIG. 6E, the draw weight of the archery bow varied from 1.01 F to 1.00 F, a difference of 1%. Thus, the draw weight of an archery bow may not be significantly altered (e.g., less than 1%) by adjusting the attachment positions of one or more limb contact members relative to the limb pocket.

As illustrated in FIG. 6E and described above, in one aspect of the present disclosure, an archer can vary the bowstring tension of his or her archery bow within a range of 12% by adjusting or repositioning one or more limb contact members relative to the pocket. Moreover, the associated draw weight of the archery bow may not be substantially affected (e.g., the draw weight only varied within a range of 1%) as a result of adjusting the bowstring tension.

In another aspect of the present disclosure, the tiller of the archery bow can be adjusted by repositioning the limb contact members within the upper and lower limb pockets. By repositioning the limb contact members within a respective limb pocket, a location at which the limb is axially supported can be varied and thereby adjust the effective length of the limb. For example, a limb supported within the limb pocket 610 as depicted in FIG. 6B will act as a stiffer limb while a limb supported within the limb pocket 610 as depicted in FIG. 6C will act as a more flexible limb. The effective length or relative stiffness of the limb can directly affect the upper and lower tiller distances (see FIG. 1B) of the archery bow by varying how the limb deflects under load.

Moreover, the tiller can be adjusted without sacrificing a draw weight adjustment range of the limb bolts. As previously described, tiller can be adjusted by rotating the limb bolts (i.e., tiller bolts) of the archery bow. For example, an archer can adjust the tiller of an archery bow by rotating an upper limb bolt clockwise a full rotation and also rotating a lower limb bolt counter-clockwise a full rotation. This method of adjusting the tiller, however, utilizes a portion of the limb bolt's finite range of rotation and thereafter limits the range in which the draw weight of the archery bow can be adjusted.

According to one aspect of the disclosure, an archer can attain a desired tiller by, for example, positioning the limb contact members of the upper limb pocket as shown in FIG. 6B while positioning the limb contact members of the lower limb pocket as shown in FIG. 6D. In this example, the full range of rotation associated with each limb bolt is preserved to allow the archer a greater range of draw weight adjustability.

In another aspect of the present disclosure, the limb contact members can be positioned within the limb pockets such that the limb is forced to twist, pivot, or otherwise turn relative to the riser. In one aspect of the disclosure, pivoting or otherwise turning a bow limb relative to the riser can allow a distal tip of the bow limb to be tuned so that it travels in a straight line while the bowstring is drawn and released. In other aspects, pivoting or otherwise turning a bow limb relative to the riser can allow an archer to adjust the travel of a distal tip of the limb to compensate for external forces affecting arrow flight (e.g., riser torque). FIGS. 7A through 9 illustrate aspects for turning, twisting, or otherwise rotating a limb about a longitudinal axis relative to the riser.

Figure 7A:
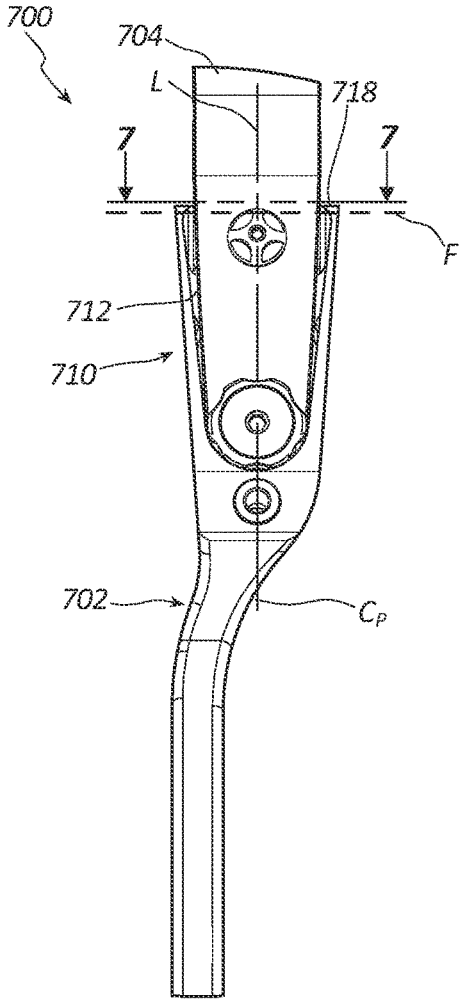
FIG. 7A depicts a front view of an upper portion of an archery bow.

FIG. 7A depicts an upper portion 700 of an archery bow according to the present disclosure. The upper portion 700 can include a riser 702, a limb 704, and a limb pocket 710. The limb 704 can define a longitudinal axis L which extends along a centerline of the limb 704. The longitudinal axis L can intersect a dovetail bolt 712 removably coupled to the limb 704. In some aspects of the present disclosure, the longitudinal axis L of the limb 704 can be aligned with a center plane $C_p$ of the limb pocket 710.

Figure 7B:
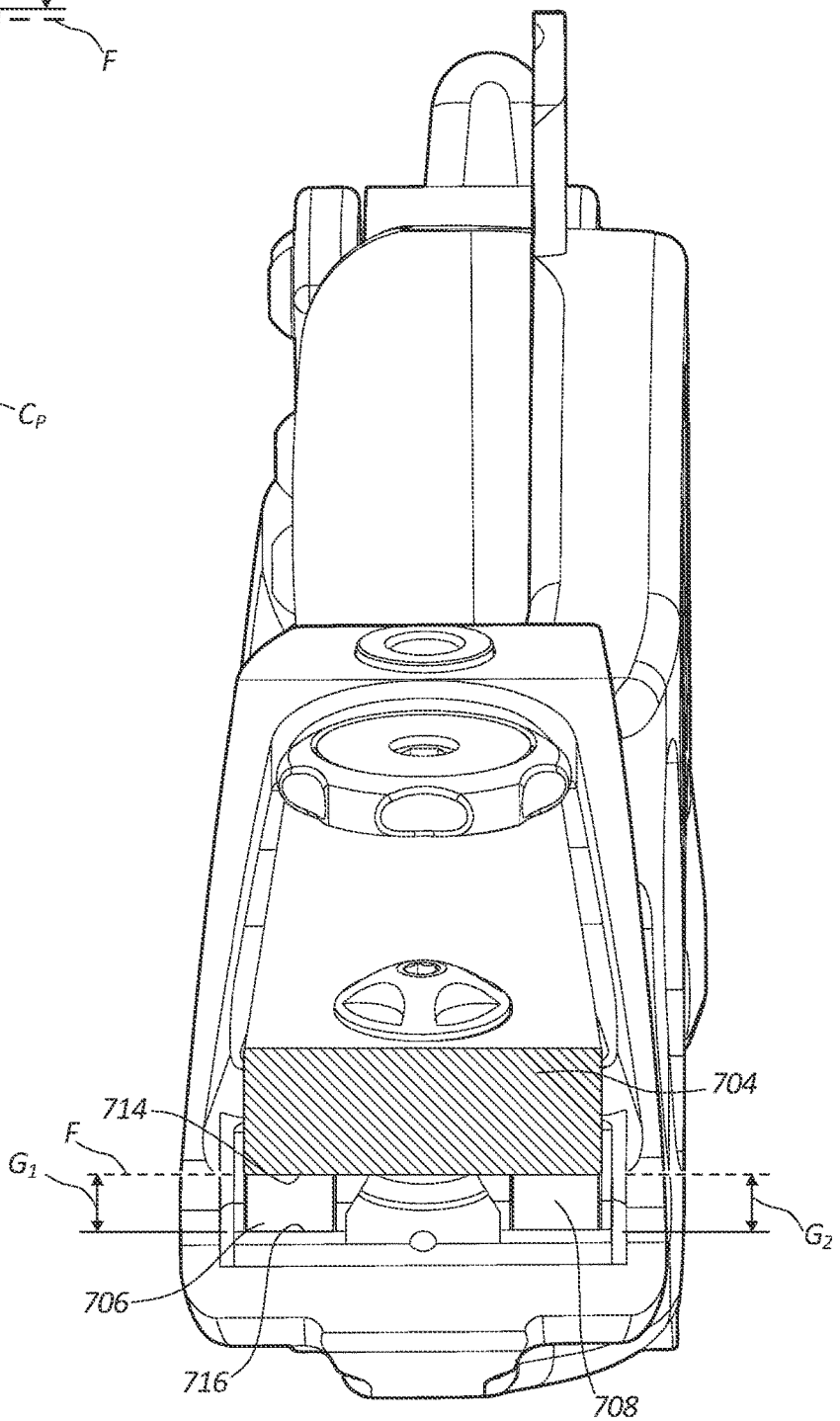
FIG. 7B depicts a top section view of an upper portion of an archery bow, where the section is taken through lines 7-7 in FIG. 7A.

FIG. 7B shows the upper portion 700 of an archery bow taken through the lines 7-7 in FIG. 7A. A first limb contact member 706 and a second limb contact member 708 can each be positioned on opposing lateral sides of the longitudinal axis L. The first and second limb contact members 706, 708 can also be positioned between a riser-facing surface 714 of the limb 704 and a limb-facing surface 716 of the limb pocket 710. In one aspect of the disclosure, the first and second limb contact members 706, 708 can each be positioned in respective channels (e.g., channels 130, 132 depicted in FIG. 2). The first and second limb contact members 706, 708 can be vertically aligned within the channels such that the first and second limb contact members 706, 708 are equally spaced from a distal end 718 of the limb pocket 710 (e.g., as shown in FIG. 2). In this aspect of the disclosure, the distance or gap between the riser-facing surface 714 of the limb 704 and the limb-facing surface 716 of the limb pocket 710 remains constant through the width of the limb 704 (i.e., gap $G_1$ is equal to gap $G_2$, as shown in FIG. 7A). Thus, the limb can be forced to bend about a fulcrum F that is perpendicular to the longitudinal axis of the limb.

Alternatively, the first and second limb contact members 706, 708 can be positioned out of vertical alignment such that the first and second limb contact members 706, 708 are unequally spaced from a distal end 718 of the limb pocket 710 (e.g., as depicted in FIG. 8). In this aspect of the disclosure, the riser-facing surface 714 of the limb 704 can be turned about the longitudinal axis L at an angle relative to the limb-facing surface 716 of the limb pocket 710 (as depicted in FIG. 9). Thus, a distal tip or end of the limb 704 can be tuned or adjusted. For example, the distal tip or end of the limb 704 can be tuned or adjusted to travel in a straight line while the bowstring is drawn and released.

FIG. 8 depicts an aspect of the disclosure wherein a limb pocket 810 includes a pocket insert 802. The pocket insert 802 can include a first channel 804 and a second channel 806 having a plurality of attachment positions. Each of the channels 804, 806 can be configured to retain one or more limb contact members 808, 812. As depicted in FIG. 8, a first limb contact member 812 can be positioned within a first channel 806 proximal to or near the distal end 814 of the limb pocket 810. The second limb contact member 808, however, can be positioned within a second channel 804 and spaced from a distal end 814 of the limb pocket 810. In other words, the first and second limb contact members 808, 812 are not vertically aligned within the channels 804, 806 and are therefore unequally spaced from a distal end 814 of the limb pocket 810.

FIG. 9 shows a view of the limb contact members arranged within the channels, taken through the lines 7-7 in FIG. 7A. The first and second limb contact members 706, 708 can be coupled to a pocket insert 702. The first limb contact member 706 can be attached to the pocket insert 702 proximal to or near the distal end of the limb pocket 710 (as depicted in FIG. 8). The second limb contact member 708 can be attached to the pocket insert 702 spaced away from a distal end of the limb pocket 710 (as depicted in FIG. 8). As the limb 704 is forced to bend, flex, or rotate about a fulcrum F (see FIG. 8) created by the limb contact members 706, 708, the limb 704 can be turned or pivoted about a longitudinal axis (e.g., longitudinal axis L of FIG. 7A) due to the position of the limb contact members 706, 708 relative to the limb pocket 710. In other words, the first and second limb contact members 706, 708 contact locations on the riser-facing surface 714 of the limb 704 which are not equivalent distances from the proximal end of the limb 704. Because the second limb contact member 708 is positioned closer to the proximal end of the limb pocket 710 than the first limb contact member 706, the limb 704 is forced to bend about a fulcrum F (see FIG. 8) that is oblique (i.e., not perpendicular) to the longitudinal axis L of the limb 704. Thus, creating an angle relative to the riser-facing surface 714 of the limb 704 and the distal end of the limb pocket 710 (i.e., gap $G_1$ is larger or otherwise unequal to gap $G_2$, as shown in FIG. 9).

Figure 10:
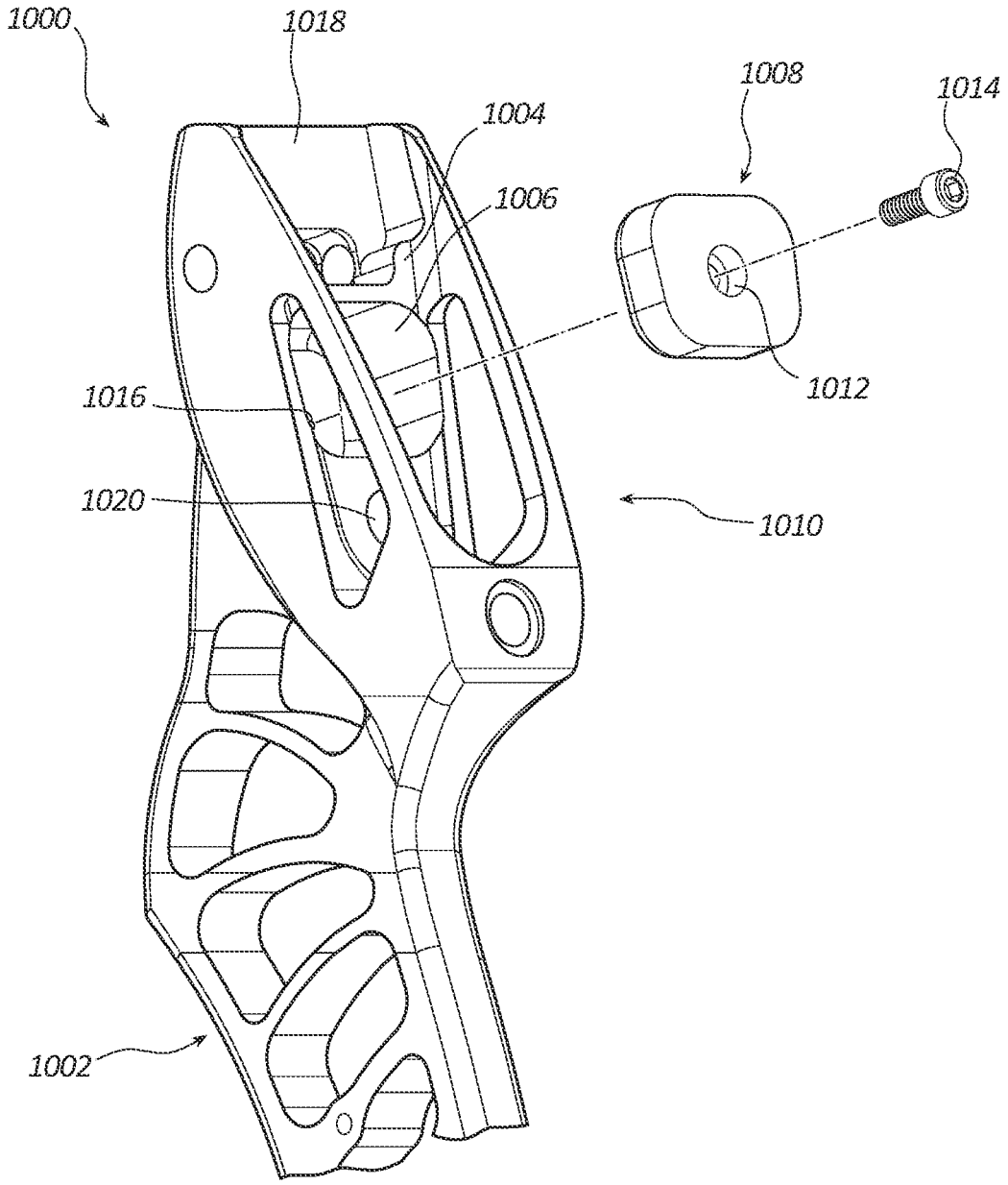
FIG. 10 depicts an exploded isometric view of an upper portion of a riser and a weight.

In yet another aspect of the present disclosure, the limb pocket of an archery bow can be configured to retain one or more weights. FIG. 10 depicts an exploded view of an upper portion 1000 of an archery bow. The upper portion 1000 can include a riser 1002 having a limb pocket 1010. The limb pocket 1010 can include a limb-facing surface 1004 having a weight recess 1006 configured to receive one or more weights 1008. In some aspects, the weight recess 1006 can be formed within or defined by the limb-facing surface 1004. The one or more weights 1008 can be coupled within the weight recess 1006 of the limb pocket 1010. For example, the one or more weights 1008 can include a through-hole 1012 configured to receive a fastener 1014. The fastener 1014 can extend through the through-hole 1012 and threadably engage with an aperture 1016 within the weight recess 1006 to retain the one or more weights 1008 within the weight recess 1006. In some aspects, the one or more weights 1008 can be configured to be stacked within the weight recess 1006 of the limb pocket 1010. In some aspects, the one or more weights 1008 can be completely or partially hidden from view when attached or coupled within the weight recess 1006 and a limb (not shown) is retained within the limb pocket 1010.

In one aspect of the disclosure, the weight recess 1006 can be formed on the limb-facing surface 1004 of the limb pocket 1010 and positioned between an insert recess 1018 and a limb bolt aperture 1020. The one or more weights 1008 can define a peripheral shape. Moreover, an outer periphery of the weight recess 1006 can be correspondingly shaped to receive the one or more weights 1008. For example, the outer periphery or shape of the weight recess 1006 can form a rectangle, square, circle, oval, or any other shape and the one or more weights 1008 can define a corresponding cross-sectional shape configured to be received within the weight recess 1006. The corresponding shape of the one or more weights 1008 can prevent the one or more weights 1008 from rotating or otherwise moving within the weight recess 1006.

Although FIG. 10 only depicts a single limb pocket 1010 configured to receive and retain one or more weights 1008, a plurality of limb pockets of an archery bow can be configured to receive and retain one or more weights. For example, an upper limb pocket and a lower limb pocket can each be configured to receive and retain one or more weights, respectively. The one or more weights 1008 can be utilized to balance or otherwise add weight to the archery bow to modify how the bow responds to the bowstring being drawn and released.

A person having ordinary skill in the art will appreciate that all of the aspects of the present disclosure described herein can be combined or otherwise utilized on multiple limb pockets of an archery bow. Moreover, all of the aspects of the present disclosure described herein can be incorporated on at least a recurve archery bow, a compound archery bow, or a cross bow. For example, the string tension of cables extending between the cams or wheels of a compound bow can be varied using aspects of the present disclosure.

Various inventions have been described herein with reference to certain specific aspects and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. An archery bow comprising:

a riser comprising:

a first limb pocket and a second limb pocket; and a handgrip portion disposed between the first limb pocket and the second limb pocket;

a first limb having a proximal end coupled to the first limb pocket via a fastener;

a second limb having a proximal end coupled to the second limb pocket;

a weight removably positioned within the riser and inside to the first limb pocket, the weight being independent of the first limb and the fastener; and a string extending between the first and second limbs.

2. The archery bow of claim 1, wherein the weight is removably coupled to the first limb pocket by a fastener that extends through the weight and threadably engages with the first limb pocket.

3. The archery bow of claim 1, wherein the first limb pocket defines a recess and the weight is at least partially disposed within the recess.

4. The archery bow of claim 3, wherein the recess is formed on a surface of the first limb pocket that is adjacent a riser-facing surface of the first limb.

5. The archery bow of claim 1, wherein the weight comprises a first weight and the archery bow includes a second weight removably coupled to the second limb pocket.

6. The archery bow of claim 5, wherein the second weight is heavier than the first weight.

7. The archery bow of claim 1, wherein the proximal end of the first limb includes a notch configured to receive a portion of the fastener comprising a limb bolt.

8. The archery bow of claim 1, wherein the archery bow is configured as one of a compound archery bow, a recurve archery bow, or a crossbow.

9. An archery bow comprising:

a limb having a proximal end and a distal end;

a riser comprising a limb pocket configured to receive the proximal end of the limb and a limb fastener, the limb pocket defining a recess within a limb-facing surface of the limb pocket;

a weight removably coupled within the recess of the riser, the weight being independent of the limb and the limb fastener, wherein the weight defines a through-hole and a weight fastener extends through the through-hole to removably couple the weight within the recess; and a bow string.

10. The archery bow of claim 9, wherein the weight is at least partially concealed between the limb and the limb pocket.

11. The archery bow of claim 9, wherein a periphery of the recess defines a recess shape resembling a square.

12. The archery bow of claim 11, wherein a periphery of the weight defines a shape resembling a square that corresponds to the recess shape.

13. The archery bow of claim 12, wherein the recess shape limits rotation of the weight while the weight is at least partially disposed within the recess.

14. The archery bow of claim 9, wherein the archery bow comprises one of a compound archery bow, a recurve archery bow, or a crossbow.

15. An archery bow comprising:

a limb having a proximal end and a distal end;

a riser comprising a limb pocket configured to receive the proximal end of the limb and a limb fastener;

a weight defining a through-hole, the weight being independent of the limb and the limb fastener, wherein the weight is disposed between the proximal end of the limb and the limb pocket such that the weight is at least partially concealed;

a weight fastener extending through the through-hole of the weight and engaging an aperture within the limb pocket to affix the weight to the limb pocket; and a string.

16. The archery bow of claim 15, wherein the weight fastener threadably engages with the aperture to affix the weight within the riser and inside the limb pocket.

* * * * *